US007654394B2

(12) United States Patent
LaVeine et al.

(10) Patent No.: US 7,654,394 B2
(45) Date of Patent: Feb. 2, 2010

(54) FLEXIBLE MAT SCREENING OR CONVEYING APPARATUS

(75) Inventors: Andrew T. LaVeine, Newberg, OR (US); Stanley L. Humiston, Sisters, OR (US)

(73) Assignee: Action Equipment Company, Inc., Newberg, OR (US)

( * ) Notice: Subject to any disclaimer, the term of this patent is extended or adjusted under 35 U.S.C. 154(b) by 411 days.

(21) Appl. No.: 11/036,599

(22) Filed: Jan. 14, 2005

(65) Prior Publication Data

US 2005/0274653 A1 Dec. 15, 2005

Related U.S. Application Data

(63) Continuation-in-part of application No. 10/867,595, filed on Jun. 14, 2004, now Pat. No. 7,344,032.

(51) Int. Cl.
*B07B 1/28* (2006.01)

(52) U.S. Cl. ..... 209/310; 209/405; 209/412

(58) Field of Classification Search ..... 209/310, 209/405, 412

See application file for complete search history.

(56) References Cited

U.S. PATENT DOCUMENTS

| | | | | |
|---|---|---|---|---|
| 1,725,511 A | | 8/1929 | Flanagan | |
| 2,230,321 A | | 2/1941 | Downs | 92/30 |
| 2,329,773 A | | 9/1943 | Leahy | 209/310 |
| 2,338,904 A | | 1/1944 | Cowles | 92/32 |
| 3,219,065 A | * | 11/1965 | Moeller | 140/108 |
| 3,378,142 A | | 4/1968 | Wehner | 209/325 |
| 3,633,745 A | | 1/1972 | Wehner | 209/310 |
| 3,647,068 A | | 3/1972 | Wehner | 209/310 |
| 3,971,715 A | | 7/1976 | Wehner | 209/310 |

(Continued)

FOREIGN PATENT DOCUMENTS

| | | |
|---|---|---|
| AT | 2993 | 12/1900 |

(Continued)

OTHER PUBLICATIONS

Photographs (five) of Bivi-TEC vibratory screening machine, Aggregates Equipment, Inc., machine Serial No. 2008 (photographs taken Jan. 2007).

(Continued)

*Primary Examiner*—Patrick H Mackey
*Assistant Examiner*—Kalyanavenkateshware Kumar
(74) *Attorney, Agent, or Firm*—Stoel Rives LLP

(57) ABSTRACT

Mechanical separators and screening machines, and methods for flexible sieve mat screening and flexible mat conveying are disclosed. In an example configuration, a flexible mat screening apparatus is provided with geometrically optimized guiding edge seals at lateral sides. One preferred configuration includes an assembly wherein a sieve mat has upwardly curved lateral sides forming a non-vertical, gradually curved shape. In another configuration, a movable support section is supported on a main frame section via a plurality of shear blocks, each arranged with its compression axis disposed horizontally. In yet another configuration, the movable support section is further connected to the main frame section via vertical stabilizers or leaf springs, the vertical stabilizers permitting longitudinal movement between the movable support section and the main frame section, but inhibiting vertical and/or lateral movement therebetween. Yet another configuration includes a boltless mat section attachment assembly.

26 Claims, 14 Drawing Sheets

U.S. PATENT DOCUMENTS

| | | | | | |
|---|---|---|---|---|---|
| 4,064,051 | A | | 12/1977 | Wehner | 210/389 |
| 4,188,288 | A | | 2/1980 | Wehner | 209/310 |
| 4,248,701 | A | | 2/1981 | Wenzel | 209/363 |
| 4,482,046 | A | | 11/1984 | Kraus | 198/771 |
| 4,632,751 | A | * | 12/1986 | Johnson et al. | 209/326 |
| 4,670,136 | A | * | 6/1987 | Schmidt et al. | 209/403 |
| 4,757,664 | A | * | 7/1988 | Freissle | 52/509 |
| 4,819,810 | A | | 4/1989 | Hoppe | 209/315 |
| 5,051,170 | A | | 9/1991 | Ahorner | 209/310 |
| 5,062,949 | A | * | 11/1991 | Hausmann | 209/310 |
| 5,595,306 | A | * | 1/1997 | Hukki et al. | 209/325 |
| 5,613,613 | A | | 3/1997 | Ahorner | 209/310 |
| 5,746,322 | A | | 5/1998 | LaVeine et al. | 209/393 |
| 5,749,471 | A | | 5/1998 | Andersson | 209/314 |
| 5,816,413 | A | * | 10/1998 | Boccabella et al. | 209/399 |
| 5,944,170 | A | | 8/1999 | LaVeine et al. | 198/762 |
| 6,179,128 | B1 | | 1/2001 | Seyffert | 209/405 |
| 6,253,926 | B1 | * | 7/2001 | Woodgate | 209/399 |
| 6,537,148 | B2 | | 3/2003 | Schwersmann | 460/107 |
| 6,659,286 | B2 | * | 12/2003 | Seyffert et al. | 209/405 |
| 7,175,027 | B2 | * | 2/2007 | Strong et al. | 209/405 |
| 2002/0195377 | A1 | * | 12/2002 | Trench et al. | 209/365.1 |
| 2005/0016901 | A1 | * | 1/2005 | Eeles et al. | 209/405 |

FOREIGN PATENT DOCUMENTS

| | | | |
|---|---|---|---|
| AT | 386137 | | 11/1988 |
| AT | 387342 | | 1/1989 |
| DE | 2108924 | | 9/1972 |
| DE | 3139279 | A1 | 4/1983 |
| DE | 3521753 | A1 | 12/1986 |
| EP | 0209777 | B1 | 7/1986 |

OTHER PUBLICATIONS

Instruction Manual and Parts List for Bivi-TEC KRL/ED 2400 X 7M OX 15°-20° "Patented Oscillation Incline Screen" (Jul. 2000).
The Liwell Screen, Hein, Lehmann US LLC, advertisement in Aggregates Manager (Jan. 2007 issue at p. 15).
Pages from Hein, Lehmann website, Liwell KT vibratory screening machine, http://www.liwell.com (visited Feb. 1, 2007).
M.A. Short, Hein, Lehmann US LLC "Flip Flow Screen—Technology for Dry Screening" (no date).
Westerkamp et al., "Solutions for Screening Problematic Materials" Aufbereitungs-Technik 38(7), 349-357 (1997).
W. Hirsch, "Flip-Flow Screens of the Third Generation" Aufbereitungs-Technik 33(12), 686-690 (1992).
Derrick Corporation, "Dry Screening Technology" Brochure, Feb. 2003.
Tema Isenmann, Inc., "Industrial Screening Systems" Brochure, 1993.
IFE Material Handling, "Double Deck Trisomat" Brochure, Jan. 1998.
Binder & Co., website, http://www.binder-co.com/index_en__2__2__1__3__1.html visited Oct. 2004.
Binder & Co., "Bivitec Binder Vibration Technology" Brochure, undated, downloaded from http://www.binder-co.com/pdfs__en/BIVITEC__eng.pdf, visited 2004.
Binder & Co., "Processing Technology" Brochure, undated, downloaded from http://www.binder-co.com/pdfs__en/konvsieb__en.pdf , visited 2004.
Heim, Lehmann, "One Screening Concept, Many Applications" Brochure, undated, downloaded from http://heinlehmann.de, visited 2004.
Liwell Flip Flow Screens, 1999, http://www.heinlehmann.de/page2-4.htm, visited May 24, 2004 (two pages).
Jost GmbH & Co. KG, "Vibrating Screens" Brochure, Mar. 2001 (six pages).
Jost GmbH & Co. KG, "Flip-Flop Screen Trampolin" Bulletin, May 2000 (one page).
Jost GmbH & Co. KG, "Circular- Motion Vibratory Screens" Bulletin, Oct. 1998 (one page).
Jost GmbH & Co. KG, "Bauma 2004" http://www.joest.com/e/start/, visited Mar. 27, 2004 (one page).
Jost GmbH & Co. KG, "Flip-Flow Screen Trampolin" Brochure, (approx. 2004) (six pages) (listed Web. Archive.org with a date Oct. 23, 2004 at http://web.archive.org/web/20041023024220/http://www.joest.com/data/SWES.pdf visited Apr. 26, 2005). Note: 2 copies provided, one color, one black & white.
IC International Combustion (India) Limited, "Flip-flop screening machine" brochure (no date).
Binder & Co., "Binder & Co. Screening Technology," Successful Internationally and at home (4 pages) (issue Mar. 2004).
Binder & Co., "Screening Technology MAWEV Show 2003," (issue Sep./Oct. 2003) (4 pages).
Urban Ingenieros S.A., "The BiriTEC screen" (Apr. 2002).
Binder & Co., "Special Screen BiriTEC principle" from http://www.binder-co.com/index__en__2__2__1__3__1.html (visited Oct. 14, 2004) ( 2 pages).
Binder & Co., Installation Listing of BiriTEC products from http://www.binder-co.com/referenzen/search/search.php?action=3&language=en&max=0&post=1 (visited Aug. 13, 2004).
Hein, Lehmann "Liwell KT" Brochure (Apr. 2003) (2 pages).
Jost "Bauma 2004" Brochure (Jun. 2004) (one page).
Brass Foundry Equipment "Vibrations" from http://www.brassfoundry.cc/Vibration/vibrators.html (visited Mar. 25, 2004) (one page).
Brochure: Polyurethane screen decks, Eurogomma (Bergamo, Italy), downloaded from: http://www.eurogomma.net/flipflow.pdf (no date), visited Nov. 8, 2007.
Bevcon Wayors Pvt Ltd, "Technologies for Future—'Straflex' Flip Flow Vibrating Screens", downloaded from: http://www.greenbusinesscentre.org/grn/mmbase/attachments/490/FlipFLowScreens__Bevcon-Ratul__Chakraborthy.pdf (no date), visited Nov. 27, 2007.
Gummi Kuper "Flexible and wear-resistant Screen panels" downloaded from: http://www.gummi-kueper.de/pics/pdf/Prospekt%20Siebbel%E4ge%20e.pdf (no date), visited Nov. 27, 2007.

* cited by examiner

FLEXIBLE MAT SCREENING OR CONVEYING APPARATUS

RELATED APPLICATION DATA

This application is a continuation in part of application Ser. No. 10/867,595 filed Jun. 14, 2004 now U.S. Pat. No. 7,344,032 hereby incorporated by reference.

BACKGROUND

The field of the present invention relates to vibratory screening machines and conveyors using flexible mats.

Various designs have been proposed for sieve mat screening machines. For example, prior art screening machines have consisted of an elongated support frame with a mobile, deformable sieve mat, typically comprised of a plurality of sieve mat sections and having lateral edges extending in the direction of the length of the support frame in a series of alternating immobile and mobile sieve mat carriers mounted on the support frame and extending transversely along the length thereof, the sieve mat sections being affixed to the carriers with the mobile carriers being movable with respect to the support frame in the direction of the length of the support frame. During cycling of the screening machine, the individual screen mat sections are alternately tensioned and relaxed. The screening machine has a flat sieve mat with seals between the sieve mat and the adjacent side walls. Material being screened by the machine would engage these side seals causing additional wear. Attempts have been made to address this wear problem. For example, U.S. Pat. No. 5,062,949 discloses a screening machine having lateral sieve mat sides that are extended upwardly relative to the carriers and raised to form vertical side walls for the sieve mat, the carriers further including support shoulders for the lateral sides of the sieve mat, and the lateral sides being free of perforations in the vicinity of the shoulder.

The present inventors have recognized certain problems and limitations inherent in the prior sieve mat screening machines.

SUMMARY

The present invention is directed to mechanical separators, screening and conveying machines or more particularly to designs and methods for flexible sieve mat screening and flexible mat conveying. In a preferred configuration a flexible mat screening apparatus is provided with geometrically optimized guiding edge seals at lateral sides. In another preferred configuration, an apparatus includes a frame assembly comprised of a main support frame section and a movable support frame section movably mounted on or connected to the main support frame section wherein the sieve mat comprises upwardly curved lateral sides forming a non-vertical, gradually curved shape which contains and redirects material toward the center of the sieve mat and away from the lateral rims. In another configuration, the movable support section is supported on the main frame section via a plurality of shear blocks, each arranged with its compression axis disposed horizontally between the main support frame section and movable support frame section. In another configuration, the movable support section is further connected to the main frame section via vertical stabilizers or leaf springs, the vertical stabilizers permitting longitudinal movement between the movable support section and the main frame section, but inhibiting vertical and/or lateral movement therebetween. In yet another configuration, an improved mat clamping system is described.

DETAILED DESCRIPTION OF THE PREFERRED EMBODIMENTS

Preferred embodiments will now be described with reference to the drawings. To facilitate description, any element numeral representing an element in one figure will be used to represent the same element when used in any other figure.

Figure 1:
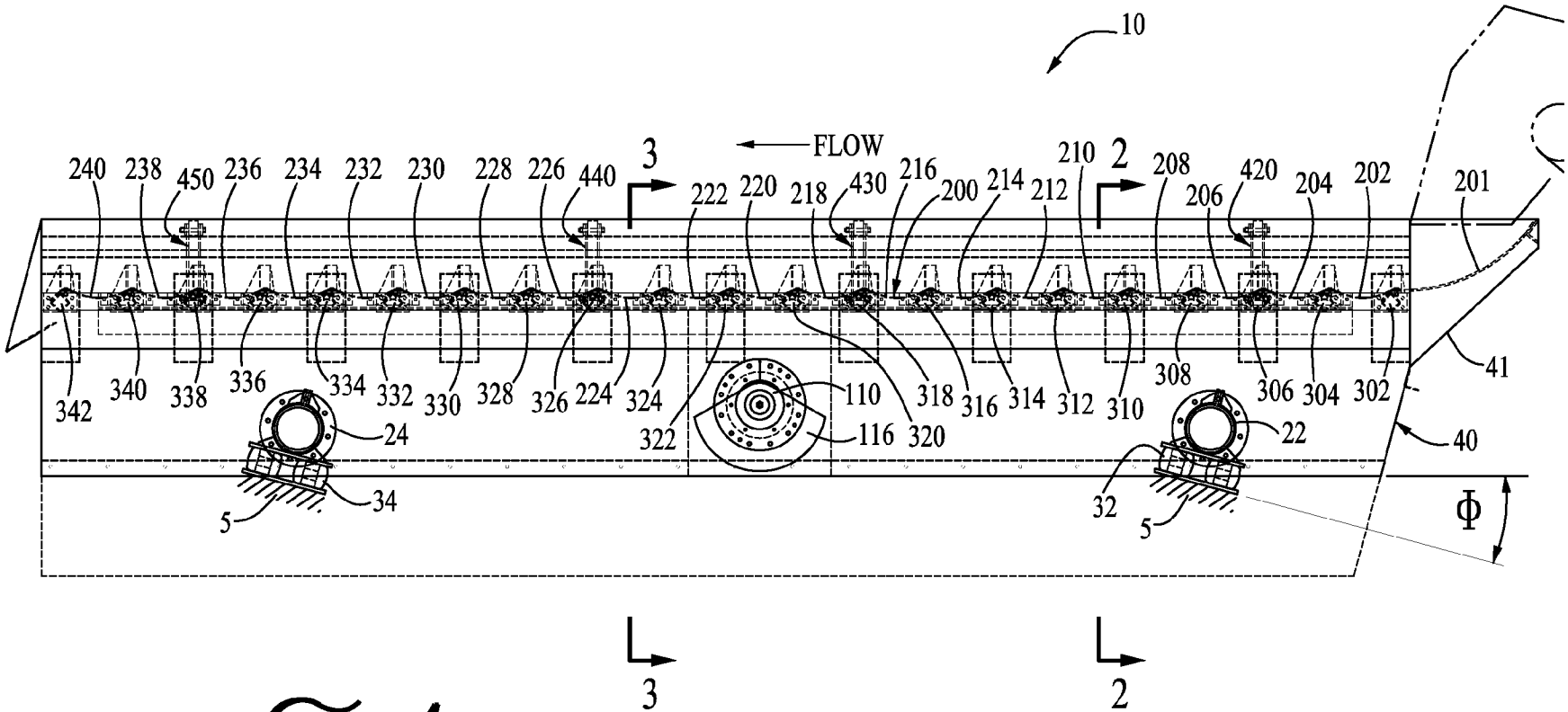
FIG. 1 is a side-sectional view of a screening apparatus according to a preferred embodiment.
Figure 2:
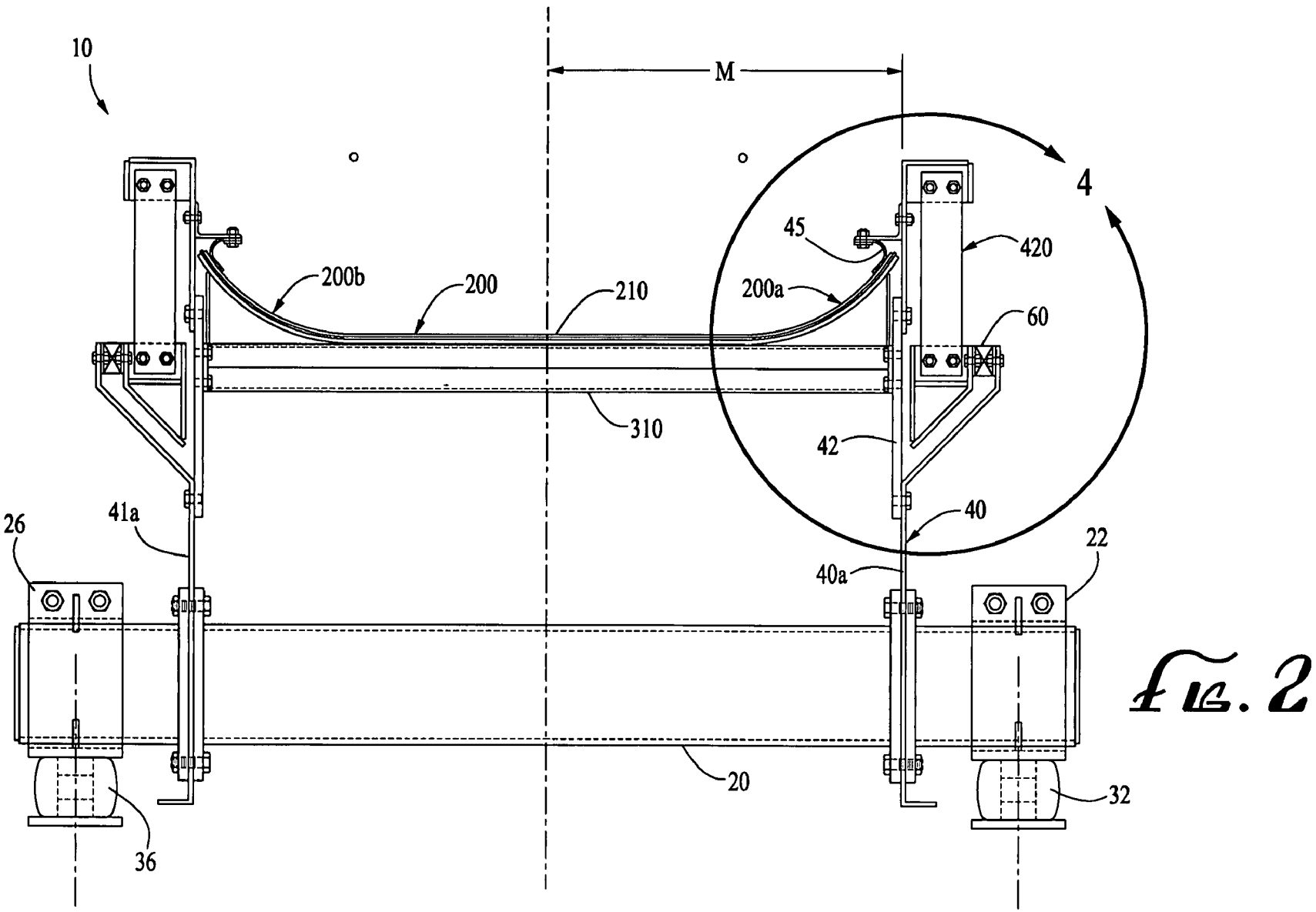
FIG. 2 is a cross-sectional view of the screening apparatus of FIG. 1 taken along line 2-2 and showing the isolation mounts.

FIGS. 1-5 illustrate a screening machine 10 according to a preferred embodiment. The screening machine 10 includes a first support frame 40 which is supported on a foundation 5 or machine frame (not shown) via a plurality of mounts, each mount being supported on a corresponding isolation spring. The screening machine of FIG. 1 is illustrated with four mounts, but other suitable number of mounts may be implemented. The side elevation view of FIG. 1 shows mount 22 on isolation spring 32 and mount 24 on isolation spring 34. Though not visible in FIG. 1, the other pair of corresponding mounts and isolation springs are symmetrically disposed on the opposite side of the support frame 40. FIG. 2 illustrates mount 22 supported on isolation spring 32 on one side of the support frame 40 and mount 26 supported on isolation spring 36 on the other side. As further shown in FIG. 2, support frame sides 40*a* and 41*a* are interconnected by a connecting member or base element 20 extending between the support frame sides 40*a* and 41*a* and the between the mounts 22 and 26. The connecting member 20 provides for stiffening connection between the support frame sides 40*a* and 41*a*.

For the purposes of description herein, vertical and horizontal will generally be described relative to the main plane of the sieve mat and the frame structure. The entire structure will preferably be mounted on a declination angle Φ to the horizontal on the order of 5° to 30°, preferably on the order of 15°. This declination angle for the sieve mat 200 provides a sloped or downhill path which, combined with the vibration drive, conveys material down the sieve mat 200. Though these ranges for the declination angle Φ are preferred examples, the machine may be oriented at any suitable declination angle. This declination angle Φ is best viewed in FIG. 1 wherein mounts 22 and 24 are shown at an angle Φ to the horizontal via the isolation springs 32 and 34. Alternately, the declination angle of the sieve mat 200 may change over the length of the unit, the actual mounting of the sieve mat 200 providing the desired declination angle(s). For example the declination angle of the sieve mat 200 may decrease either continuously or in stages/steps. For example, the declination angle of the sieve mat 200 at the first sieve mat section 202 may be at 20° and decrease to 15° or 10° at the last mat section 240. A continuous "banana" type declination may provide operational, efficiency and/or wear advantages and potentially decrease the overall machine footprint.

Figure 3:
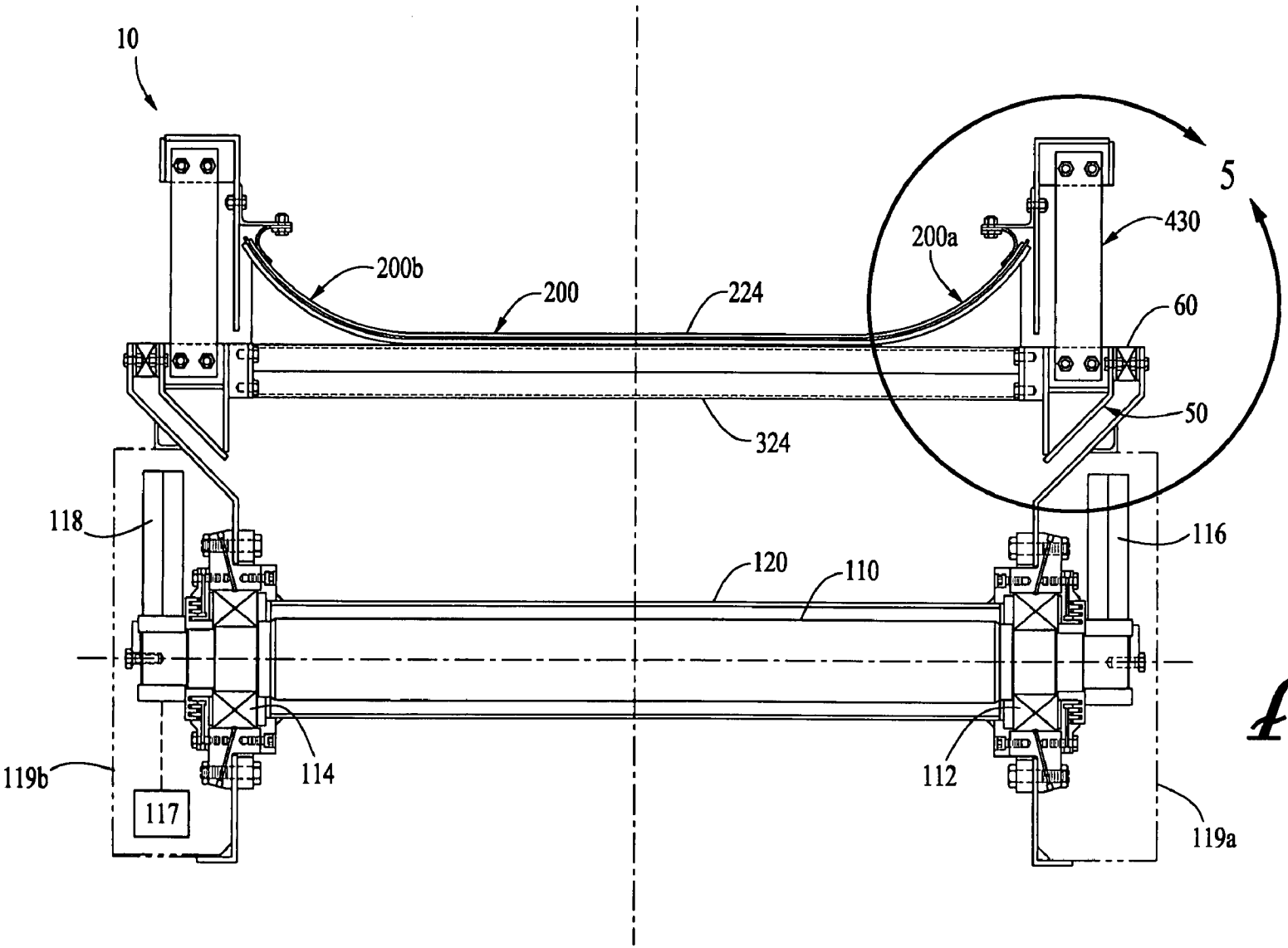
FIG. 3 is a cross-sectional view of the screening apparatus of FIG. 1 taken along line 3-3 and showing the eccentric drive.

As shown in FIGS. 1 and 3, a drive shaft 110 is supported and mounted by bearings 112, 114 which are in turn mounted onto the main support frame 40. As the shaft 110 is rotationally driven by the drive motor (the drive motor being schematically illustrated as element 117), an orbital vibrating motion is applied by the eccentrics 116 and 118 disposed on opposite ends of the shaft 110. The vibration could be applied by a single eccentric on a single side of the unit, but by extending the shaft 110 to opposite lateral sides of the unit and applying eccentrics on both sides of the frame 40, a more balanced orbital vibratory force is applied across the frame system 40. A drive cover 119 is disposed over each of the drive ends for preventing access to the moving parts. Other suitable vibration application systems may be utilized such as a type that applies varying horizontal and/or vertical stroke components. The shaft 110 is illustrated as a six-inch diameter internal shaft passing through the bearings 112, 114 and extending out through the entire width of the frame assembly 40. The shaft 110 is surrounded by a fixed eight-inch pipe 120 which extends between the mounting of the bearings 112, 114. The dimensions and locations of the shaft 110 and the pipe 120 are given merely as examples to illustrate relative sizes between the shaft and pipe components. The pipe 120 has end flanges which secure the pipe to the side frame assembly at the mounts for the bearings 112, 114. The pipe 120 provides for lateral support and stiffening between the bearing shaft mounts. The eccentrics 116, 118 on opposite sides of the shaft 110 are preferably located at the same angular position relative to the shaft 110 so as to provide a balanced application of the orbital vibration force from the shaft 110 through the bearings 112, 114 and into both sides of the frame assembly 40. The drive shaft 110 may be positioned near the machine center of gravity or at some other suitable location.

The drive shaft 110 disclosed above is just one type of suitable drive mechanism. For example, the drive mechanism may comprise a single drive shaft 110 or may comprise multiple shafts driven by one or more drive motors.

The sieve mat 200 extends longitudinally across the length of the screening apparatus 10 from the inlet section 41 (shown at the right hand side of FIG. 1) to the outlet side on the left. Though the sieve mat 200 may comprise a single piece of material, the sieve mat 200 is preferably a series of removable transverse sections or strips 202, 204, 206, 208, 210 . . . 240 with each mat section being supported by a pair of transverse mat supports 302, 304, 306, 308, 310 . . . 342. The sieve mat supports are in the form of square tubes arranged with a corner disposed tangentially to the mat 200. Though the illustrated square tube configuration and tangential orientation provides a desirably high strength and stiffness to weight ratio, other shapes and orientations for the mat supports may be utilized. One such example are the rectangular tubes described below with respect to FIG. 9 et seq. whereby the long sides of the rectangle are vertically oriented.

The sieve mat supports 302, 304, etc. are alternately connected to either the main support frame section 40 or the movable support frame section (also referred to as the balancer support section 50). Thus the frame tube supports (302, 306, 310 . . . 342) are connected to the main support frame section and the balancer tube supports (304, 308, 312 . . . 340) are connected to the balancer 50. The balancer 50 is supported via shear blocks 60 and/or the vertical stabilizers 420 etc. as will be described below in further detail with respect to FIGS. 3 and 5. Each sieve mat section is connected on one end to a frame tube support (302, 306, 310 . . . 342) and on the other end to a balancer tube support (304, 308, 312 . . . 340). For example, mat section 206 is connected on the upstream end to frame tube support 306 and on the downstream end to balancer tube 308. The operative functions of these connections will be described in further detail below.

As shown in FIGS. 2 and 3, the apparatus 10 is symmetrically configured with each of the lateral sides (i.e. the left and right sides as viewed in FIGS. 2 and 3) having like configuration. Thus for conciseness of description, only one of the sides will be described and like description will be applicable to the other side. Alternately, the other side need not be entirely symmetrical. For example, the slope of the upturned section 200*a* of the mat section 210 of FIG. 2 may be of a different curvature than the upturned section 200*b*.

Figure 4:
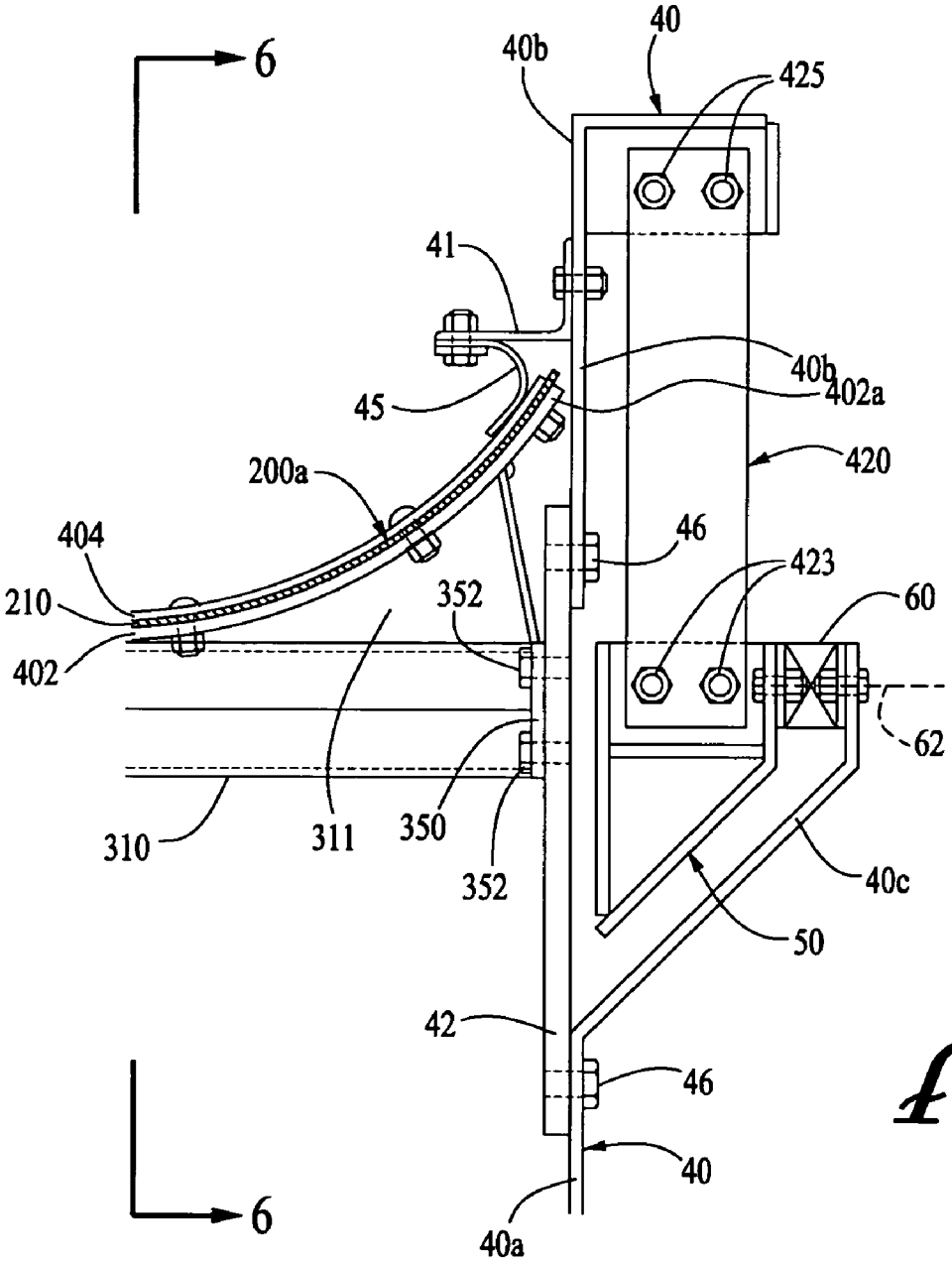
FIG. 4 is a detailed view of a portion of FIG. 2 showing details of the support connection for the frame tube.
Figure 6:
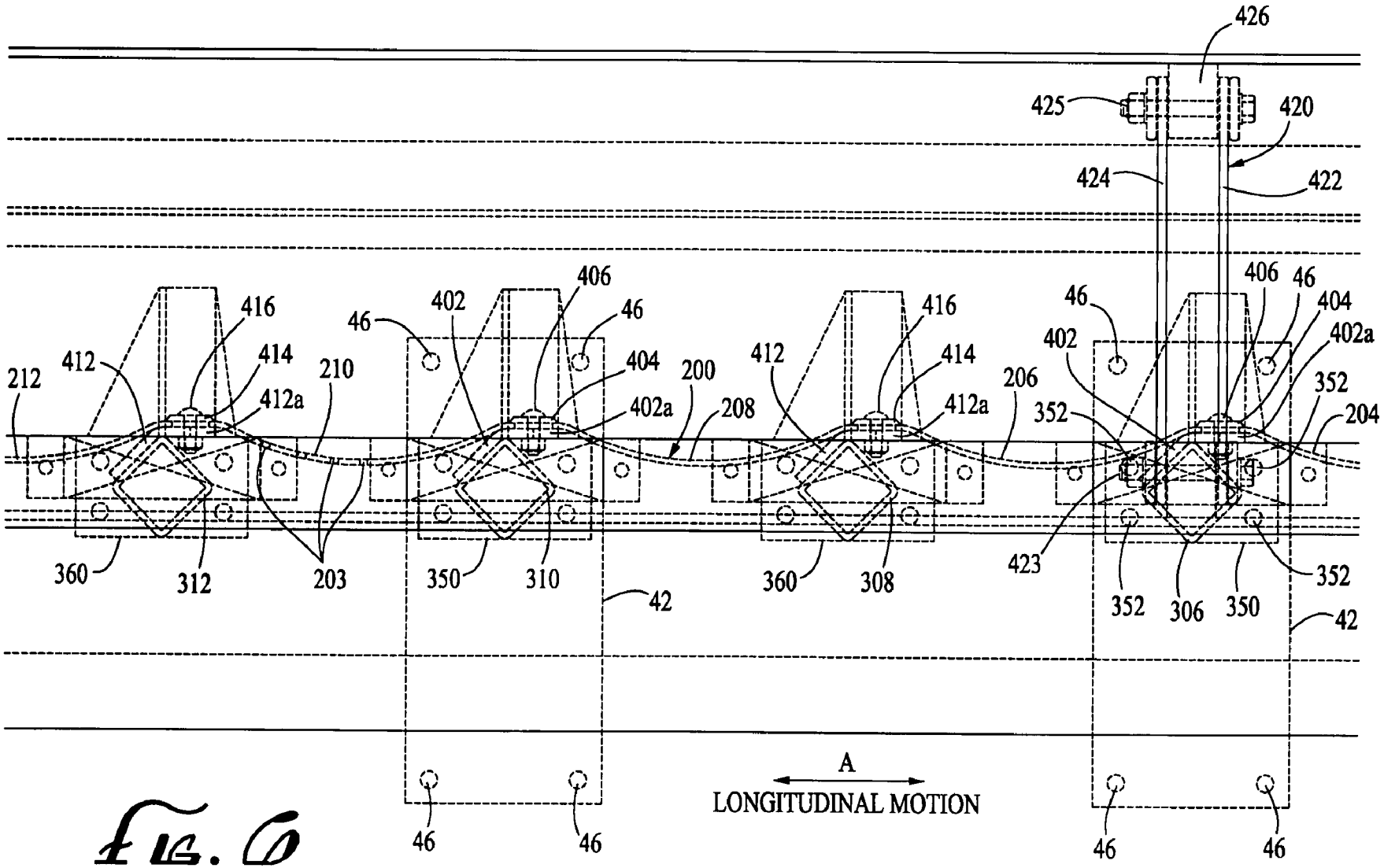
FIG. 6 is a partial cross-section of a portion of the screening apparatus showing four support tubes taken along line 6-6 of FIG. 4.

Each of the frame tube assemblies 302, 306, 310 . . . 342 has essentially the same configuration and the description of one of the tubes should provide adequate description for any of the other frame tube assemblies. FIG. 2 illustrates detailed cross-section of FIG. 1 taken along line 2-2 whereby a frame tube assembly 310 is supported directly to the main support frame section 40 via connector 42. As best shown in FIGS. 2 and 4, the frame tube 310 comprises a square tubing arranged below the sieve mat 200 extending transversely along the width of the frame assembly 40. The frame tube 310 includes an end flange 350 welded thereon for attachment to the connector 42. The connector 42 has four holes which have been drilled and tapped for accepting the bolts 352 which secure the flange 350 onto the connector 42. The connector 42 is in turn connected by a series of four bolts 46 which are secured into tapped holes located in the connector plate 42 as best shown in FIGS. 4 and 6. As shown in FIG. 4, the frame tube 310 is directly connected to the support frame 40 both at a lower section 40*a* and then upper section 40*b* by a connection through the connector plate 42. Other connection mechanisms may be used such as through bolt and nut, welding, rivet, or any suitable fastener.

Figure 5:
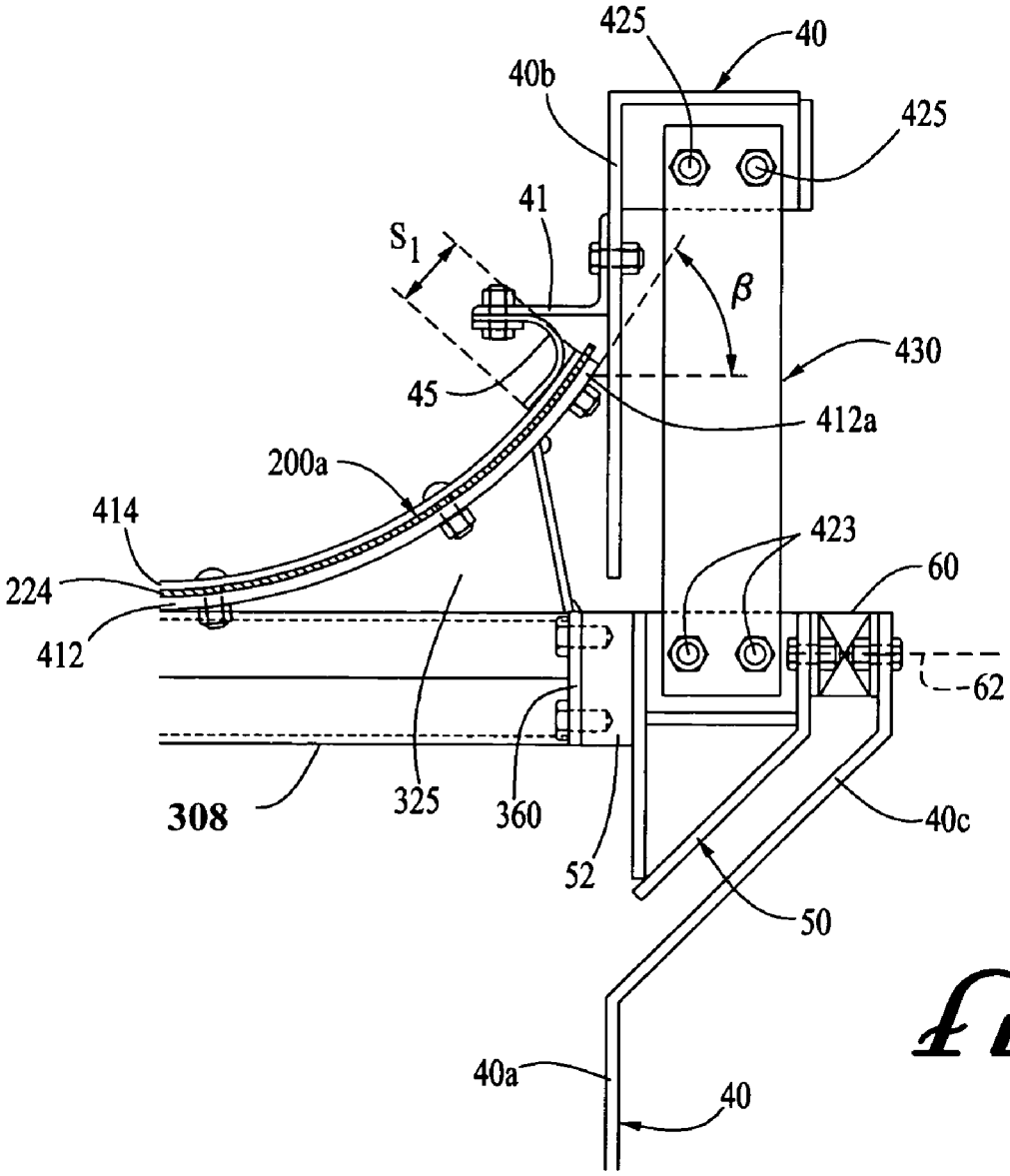
FIG. 5 is a detailed view of a portion of FIG. 3 showing details of the support connection for the balancer tube.

Each of the balancer tube supports 304, 308, 312 . . . 340 has essentially the same configuration and the description of one of the balancer tube assemblies should provide adequate description for any of the other balancer tube assemblies. The balance tube assembly is shown with reference to FIGS. 3, 5 and 6 where the balance tube 308 from FIG. 1 is illustrated in more detail. As best shown in FIGS. 5 and 6, the balance tube 308 and flange 360 are the same configuration as the frame tube 306 and flange 350. The balance tube 308 is mounted differently, however, as the flange 360 at the end of the tube 308 is connected to a spacer 52 which in turn is mounted to the balancer 50. The balancer 50 approximately extends the length of the unit 10 and is spring-mounted to the frame 40 via a plurality of shear springs 60 and vertical stabilizers 420, 440 etc. Each shear spring 60 is oriented with its compression axis 62 disposed horizontally between the angular upper section 40*c* of the frame 40 and the balancer 50. The shear spring 60 allows the balance tube 308 to move in any direction perpendicular to the plane of FIG. 5 placing the spring in shear whereas placing the spring in compression or tension along axis 62 would provide for relatively smaller movement along that lateral direction. The unit 10 will include a plurality of shear blocks installed on each side thereof providing for a balanced and even support for the balancer. In one configuration, the machine includes ten shear blocks disposed on each side of the unit, but any suitable number of shear blocks may be employed. The shear blocks may be comprised of any suitable resilient material of any durometer, such as rubber or polyurethane, and arranged to allow a difference in motion in the longitudinal directions while inhibiting motion in the transverse direction. The shear blocks permit motion in the desired direction and provide a spring force (rate) for that desired motion.

The sections 202, 204, 206, etc. of the frame mat are transversely connected to the respective frame tube or balancer tube along the length of the mat 200. Any suitable attachment scheme may be used. FIG. 6, for example, illustrates frame tube 306 having an angle bar 402 which is welded to one side of the tube 306 and having an upper section 402*a* which contacts the undersurface of the mat sections 204, 206. A top clamp bar 404 sandwiches the mat sections 204, 206 along the width, and the mat sections 204, 206 are secured by a plurality of spaced bolts 406 along the transverse width of frame tube support 306. Similarly, the balance tube 308 includes an angle bar 412 secured on one side thereof and having an upper bar section 412*a* that supports the undersurface of the mat sections 206, 208 with the clamp bar 414 being secured by a plurality of spaced bolts 416 along the transverse width of the balance tube 308 sandwiching the mat sections 206, 208 therebetween. The construction of the like components for the frame tube assembly 310 is the same as frame tube assembly 306 and the construction of the like components for the balancer tube assembly 312 is the same as balancer tube assembly 308 and thus are not repeated.

Figure 7:
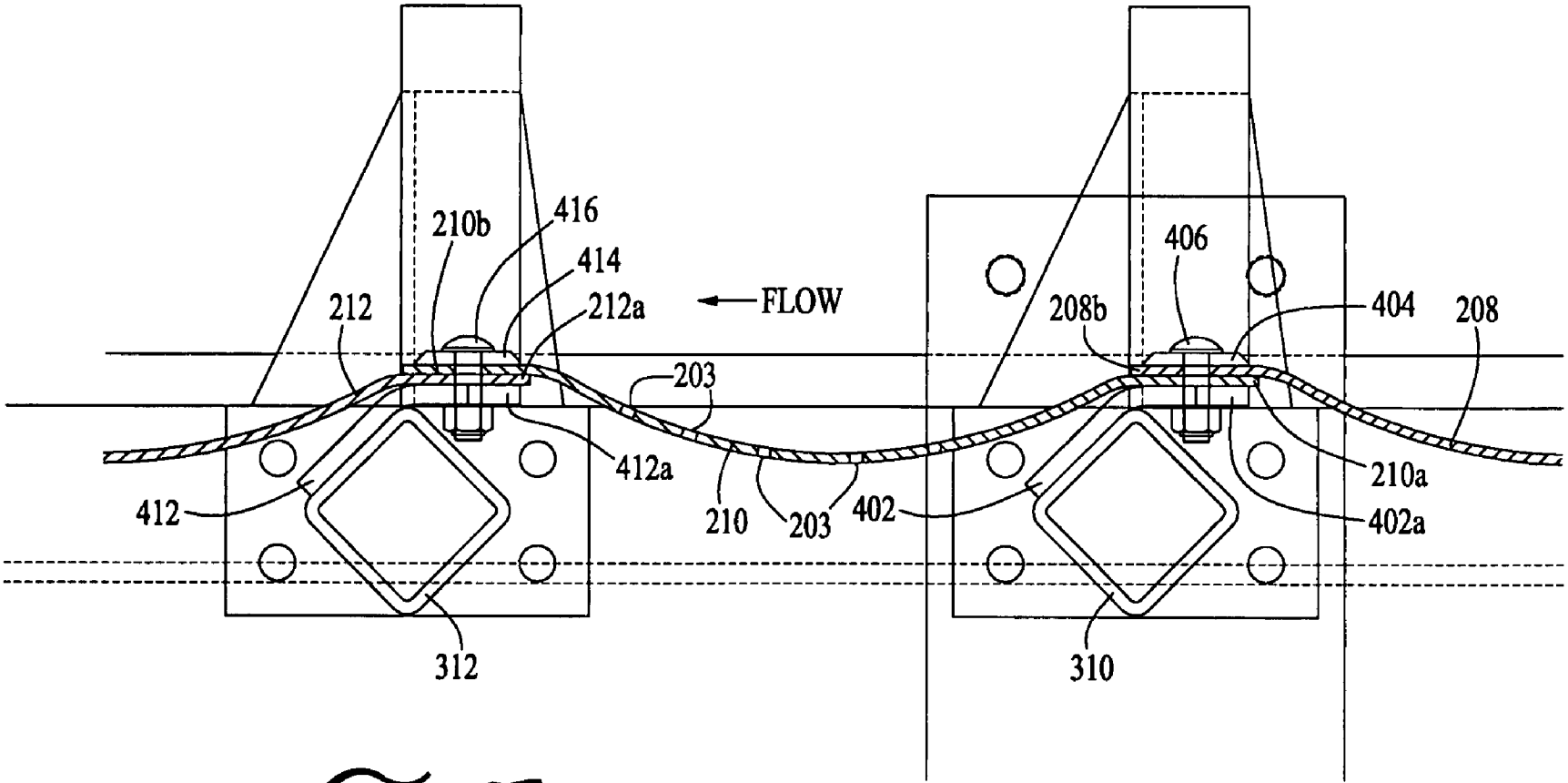
FIG. 7 is a partial cross-section of a portion of the screening apparatus showing an alternate connection mechanism between the sieve mat sections.

In the embodiment of FIG. 6, the mat sections are secured to the respective frame tube support or balancer tube support with the adjacent mat sections positioned end-to-end, the ends butting up to each other and secured between the top clamp bar and the angle bar upper section. Alternately, the mat sections may have ends constructed so as to mate with a tongue-and-groove configuration, include alignment notches and teeth, or as shown in the embodiment of FIG. 7 below, may be designed with an overlap. The mat sections may be connected via bolts as shown, or alternately via fastening wedges or other suitable boltless connection. One example of a boltless connection is described below with respect to FIGS. 9-14.

FIG. 7 illustrates an alternate configuration for connecting the sieve mat sections to the respective frame tube and balance tube in which the respective mat sections overlap. Three sieve mat sections 208, 210, 212 are shown. From opposite directions, over the frame tube 310, both the trailing end 208*b* of the mat section 208 and the leading end 210*a* of the mat section 210 extend past the top clamp bar 404 and the angle bar upper section 402*a* of angle bar 402. The ends 208*b* and 210*a* are then secured together, pressed between top clamp bar section 404 and the angle bar upper section 402*a* as secured by bolt 406. The overlapping mat sections provide a large sealing surface area for preventing material from passing between the mat sections at this interconnection.

Preferably, the trailing edge of a mat section is positioned over the leading edge of the next (downstream) mat section providing for a more smooth contour for material moving in the flow direction.

In like manner over balancer tube 312, from opposite directions, both the trailing end 210*b* of the mat section 210 and the leading end 212*a* of the mat section 212 extend past the top clamp bar 414 and the angle bar upper section 412*a* of angle bar 412. The ends 210*b* and 212*a* are then secured together, pressed between top clamp bar section 414 and the angle bar upper section 412*a* as secured by bolt 416. The overlapping mat sections provide a large sealing surface area for preventing material from passing between the mat sections at this interconnection.

The motion of balancer 50, and correspondingly the balancer tubes 304, 308, 312 . . . 340, are restrained in the vertical direction by operation of vertical stabilizers 420, 430, 440, 450 which connect between the balancer 50 and an upper section 40*b* of the main frame 40. Similar stabilizers are disposed on the other side of the unit 10. The construction of stabilizer 420 is representative of each of the other stabilizers 430, 440 etc. and is described in the following. As shown in FIGS. 4 and 6, the stabilizer 420 includes a pair of flexible spring plates 422, 424 secured at a lower end to the balancer 50 via bolts 423, 423 and secured at the upper end via bolts 425, 425, the spring plates 422, 424 being separated by spacer 426. Because of the plate geometry of the spring plates 422, 424 functioning as a leaf spring, the stabilizer 420 permits relative rocking or longitudinal movement in the direction of the arrow A in FIG. 6 as between the balancer tubes (as a group) and the frame tubes (as a group) but provides stiffening connection for inhibiting relative motion either vertically or laterally. The vertical stabilizers may be composed of any suitable device such as links, slats, plates, rocker arms, etc. that restricts relative vertical motion between the balancer 50 and the main support frame while allowing motion in the longitudinal (horizontal) direction. The balancer assembly 50 is preferably suspended via the vertical stabilizers 420, 430, 440, etc. such that the weight of the balancer assembly 50 is supported by the vertical stabilizers rather than the shear blocks 60 thereby preventing pre-stressing or over-stressing the shear blocks 60 in the vertical direction.

The vertical stabilizers may be constructed of any suitable material such as metal (e.g. spring steel etc.) or a composite material.

Both the vertical stabilizers 420, 430, 440 etc. and the horizontally mounted shear blocks 60 serve to minimize lateral movement which reduces fatigue/wear on the sieve mat. Minimizing lateral movement is particularly useful in reducing fatigue/wear at the curvature area. By properly constraining the movement of the balancer, a consistent stroke may be achieved thereby enhancing component life and screening efficiency.

Thus when the frame assembly section 40 is driven via the eccentric drive mechanism 110/116, the frame section 40 is driven in an orbital pattern as permitted by the isolation springs 32, 34, 36. The balancer tube supports 304, 308, 312 . . . 340 mounted on the balancer 50 have the flexibility to move longitudinally (direction A in FIG. 6) relative to the frame tube supports 302, 306, 310 . . . 342 via the shear springs 60 and the vertical stabilizers 420, 430, 440, etc. Thus the distance between adjacent tubes alternately increases and decreases alternately flexing and unflexing the mat section therebetween.

The sieve mat 200 may comprise a continuous unit for the various mat sections 202, 204, 206, etc. or may comprise separate transverse sections of a given length secured at each tube assembly via the bolt and clamps described above or some other suitable connection mechanism. Each of the sieve mat sections 202, 204, 206 etc. is preferably homogenous, uniform, unitary, and one-piece without splices. A configuration with separate sections permits replacement of a single section, such as section 204 or section 206, for replacement or repair without requiring replacement of remaining sieve mat sections such as sections 208, 210 etc.

The sieve mat 200 includes perforations along its length (see for example the perforations 203 in mat section 210 of FIG. 6), the perforations being of a size and shape so as to permit particles of a given size to pass through for sorting. The individual perforations may be tapered and arranged in any suitable pattern and location. For example, it may be expected that the inlet mat section 201 may comprise no perforations as that section may be designed to merely direct material into the screening area. It may be preferred that the perforations not extend at the connection sections under the clamp bars 404, 414 since that area is covered by the clamp bar anyway and thus can provide no screening function Thus the perforation size, shape and pattern as well as the material and thickness will be chosen for the given material screening application.

The sieve mat may be formed of any suitable material which has the desirable properties of flexibility and strength in addition to abrasion, rust and corrosion resistance. The material used for the sieve mats is mechanically strong and preferably a resilient elastomer with a balanced range of properties which is able to withstand deformation without loss of elasticity or dimensional accuracy. One such material is a resilient flexible polymer such as polyurethane for example. The sieve mats may be constructed of single homogenous material or may be reinforced such as with internal cables or bars, or with a suitable screen backing.

The motion of the sieve mat sections is such that in the unflexed condition a sag will be formed, such as for example the sag in the mat sections 206, 208, 210 visible in FIG. 6. Then moving to the flexed condition, the mat section will be snapped toward a flatter/straighter form. Referred to as a "flip flow" method, during the cycling of the screener, the flexible mat sections are individually tensioned and relaxed which breaks or loosens the adhesive bond between materials and between the material and the screen mats. In the upstroke, material is impelled upwardly functioning much like a trampoline and air is drawn into and thru the material. The motion is such that in an example screening machine, the acceleration on the main support frame is about 3 g's, but the material on the sieve mat may experience up to 50 g's. Sieve mat flexing may also stretch or bend the perforations helping to release particles that might become lodged in the perforations, a process called "breathing." The flip flow method is useful for screening a wide variety of materials, including the more difficult applications such as:

screening of moist, sticky and fibrous materials,
small particle and high fines content screening,
screening of near size particles.

As shown in FIGS. 2-5, the lateral sides of the sieve mat 200 are formed with a gradually curved transition arc or turned-up section which will be generally referred to as element 200*a* in any of these figures. This curved section 200*a* serves to contain material being screened by the system, redirecting material riding up the sloped lateral edges back toward the central portion. The sieve mat 200 (comprised of the various mat sections) is secured and supported at the curved sections 200*a* by continuation of the clamp bar 404 and the upper section 402*a* of support bar 402 which extend approximately the entire lateral width of the respective mat sections, generally to the end of the mat 200. Since an angled bar section 402 is impractical to form into the desired curvature, only a flat bar section (upper support bar section 402*a*) extends into the curved mat section 200*a*. The upper support bar section 402*a* is supported in its upwardly curved position via a gusset 311 welded between the frame tube 310 and the upper support bar section 402*a*.

Similarly, the balance tube 308 includes a gusset 325 attached to the balance tube 308 and the upper support bar section 412*a* forming the curved mat section 200*a* as disposed between the clamp bar 414 and the upper support bar section 412*a*.

To further prevent exit of material over the top edge of the curved section, a sliding seal arrangement 45 is disposed along the top surface of the mat 200 near the top edge of the curved section 200*a*. The seal 45 is preferably a flexible material of sufficient resilience so as to maintain a fairly wide contact surface $S_1$ against the top of the mat surface over the range of relative motion between the two elements. In such a design, the contact surface serves to provide the sealing surface for inhibiting passage of material. Alternately, the seal 45 may be configured with a non-flexible element mounted so as to maintain a gap between the seal 45 and the top of the mat surface thereby forming a baffle for inhibiting passage of material. The gap configuration comprises a non-contact, low-friction system that may minimize friction wear.

Unlike the sharp-angled side sections of the screening sieve mats of the prior art which reach an entirely vertical orientation, the curved section 200*a* of the preferred embodiment takes on a much more gradual curve resulting in a maximum rise to run ratio y/x of about 1.0. A preferred maximum rise/run ratio may be even more gradual, such as on the order of 0.75 or less.

Figure 8:
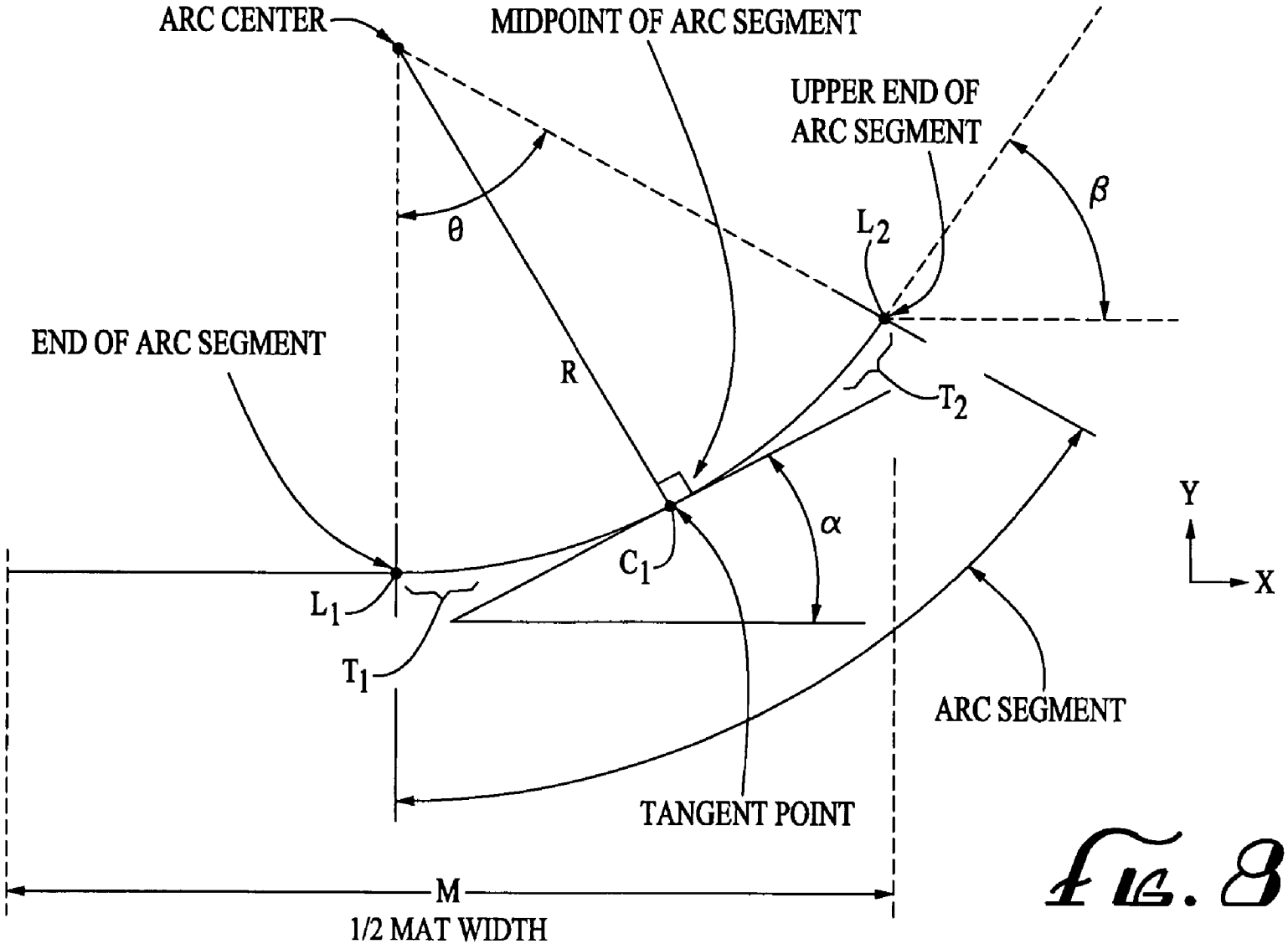
FIG. 8 is a schematic of a side section of a sieve mat according to preferred embodiment.

The arc of the curved section as shown in FIG. 8 is a gradual arc that will depend upon several factors including the thickness of the sieve mat 200 and the overall size of the screening machine. One method of defining such a gradual curved or transition arc shape is locating a midpoint $C_1$ of the arc and drawing a tangent line through that midpoint which forms an angle a to the horizontal. Preferably, a would be less than about 45° to help ensure the desired gradually curved form.

The sharpness of the curved form may also be defined by the radius R formed by the arc at any point along the curved section. The entire curved segment need not have the same radius R throughout its positions. For example, at the initial transition $T_1$, the curvature may be more gradual as the sieve mat transitions from horizontal to curved. Thus the radius of curvature R may decrease, i.e., the sharpness of the curvature increasing, from transition $T_1$ at the curvature beginning point $L_1$ to center point $C_1$ and potentially beyond to the ending transition $T_2$ at end point $L_2$.

Since the shape of the curved section 200*a* is preferably formed with a gradual slope, such a shape would require a much larger width in order to reach an absolute vertical. Thus, it is preferred that this side of the mat not reach absolute vertical and only reach a height and slope sufficient to prevent material from passing over the top of the mat surface past the seal 45. The slope of the curved section at the end of mat 200, shown by element numeral β in FIG. 8, should not exceed about 75% of vertical resulting in value for β not to exceed about 67.5°.

The total transition arc section may also be referred by a curvature angle θ as shown in FIG. 8. For an angle θ equal to 90°, the side of the curved section would reach vertical. Thus the curvature angle θ is preferably significantly less than 90° and more on the order of 70° or less.

Another method or design of defining the gradualness of the curved shape is via the radius R at any given point along the arc. For a typical size screening apparatus such as the unit 10 illustrated in FIG. 2, the total width is about 5 ft, thus M=2.5 ft or 30 inches. The value for R, the radius at the arc center point $C_1$ (for purposes of illustration, this radius is measured at the back/outer surface of the sieve mat) is about 15 inches for a typical size screening machine. Thus for a typical size screening apparatus, the radius R would preferably be in a range on the order of: 6 inches≦R≦30 inches, or more particularly on the order of at least 12 inches. The upper range may be limited by design efficiencies or design criteria for a specific application. Preferably the radius is large enough to reduce buckling and small enough to maximize the amount of flat area on the screen mat and thus is essentially a compromise between these two factors.

In order to create a dimensionless value, a comparison may be made between the radius R and the mat width. Comparing the mat size M (half the width of the mat as shown in FIG. 2 or 6) to the radius R, a ratio R/M may be formulated. For the example in FIG. 2 where R=18 inches and M=30 inches would yield a value of 0.6 for the R/M ratio. The actual radius and R/M ratio may depend upon the particular size of the device, the mat thickness, the overall design and material being screened. A preferred range for the R/M ratio would be on the order of R/M≧0.2 and range upwards to about 1.0 or possibly higher.

The gradual curved shape results in lower mat strain or stress at the transition. In Example 1, for a screening apparatus with a vertical side edge having a 6 inch radius undergoing a 2 inch screen mat offset would have a arc length of 12.56 inches when draped and 9.42 inches when undraped for a difference of 3.24 inches which equates to 3.14/9.42=0.33 inches of stretch per inch of arc. The sieve mat of Example 1 is more susceptible to buckling, and thus forms a crease which is permanent. In a preferred configuration of Example 2, for a screening apparatus with a more gradual and non-vertical side edge having a 15.145 inch radius undergoing a 2 inch screen mat offset would have an arc length of 17.5 inches when draped and 15.5 inches when undraped for a difference of 2.0 inches which equates to 2.0/15.5=0.13 inches of stretch per inch of arc. Thus screen mat of Example 2 with a preferred gradual arc shape and non-vertical side edge exhibits 60% less screen mat strain than the screen mat of Example 1. In other words, the screen mat of Example 1 exhibits 250% more strain than the screen mat of Example 2.

The curved sections 201 are preferably fully perforated to the same extent as the central mat region—thus screening of material also takes place in the curved section. Further, the gradual arc will tend to minimize screen mat buckling in that region, providing a better range of movement. The screen mat sections are preferably seamless and without creases all the way from the center to the lateral edge. This gradual curved section provides a smooth transition from the horizontal presenting a sweeping radius and a smooth guiding edge for the material while reducing fatigue issues by utilizing a greater radius without vertical sides. Thus the curved design may provide longer wear life.

The sieve mat 200 may be configured not only with a curved section 200*a* at the side edges, but may have continuous (or discontinuous) curvature throughout the central portion therebetween. Utilizing the disclosed gradual curved design, the mat sections may be formed in a continuous arc or trough all the way from the side edge to the center or even a waffle or sinusoidal shape.

Functionally, the gradual curved edge section optimizes screen mat geometry and may provide one or more of the following advantages:

- easier to fabricate;
- under normal material depths, the product does not continually come in contact with the upper portion of the curvature area;
- keeps material away from the top mat edge and seal by potentially "flipping" material back to the horizontal screen surface;
- allows for freer flipping of the screen mats in the curvature area while still providing side sealing;
- reduces screen mat edge wear common to flat screen without sides;
- reduces wedging between the material and the sides;
- reduces build-up and caking at the screen mat corners due to screen mat flexing along the entire screen mat length;
- provides a constant stress gradient and reduces the "unit deformation" of the sieve mat material with stress spread over a larger area by allowing greater movement along the screen mat length thus increasing screen mat life;
- functions as a side border for guiding material;
- effective screening can be accomplished along the entire screen mat length due to relatively consistent movement throughout;
- avoids undesirable abrupt corners or joints.

The screening apparatus may be combined with other types of screen mechanisms. For example a scalping screen may be mounted above the mat 200 to provide a pre-screening of large particle material.

The disclosed drive mechanism only drives the main frame section as the balancer is "floating" or sympathetic mechanism responding to the motion of the driven main frame section. Alternately both the main frame section and the balancer may be driven by a suitable drive mechanism and alternately controlled by a motor controller.

Figure 9:
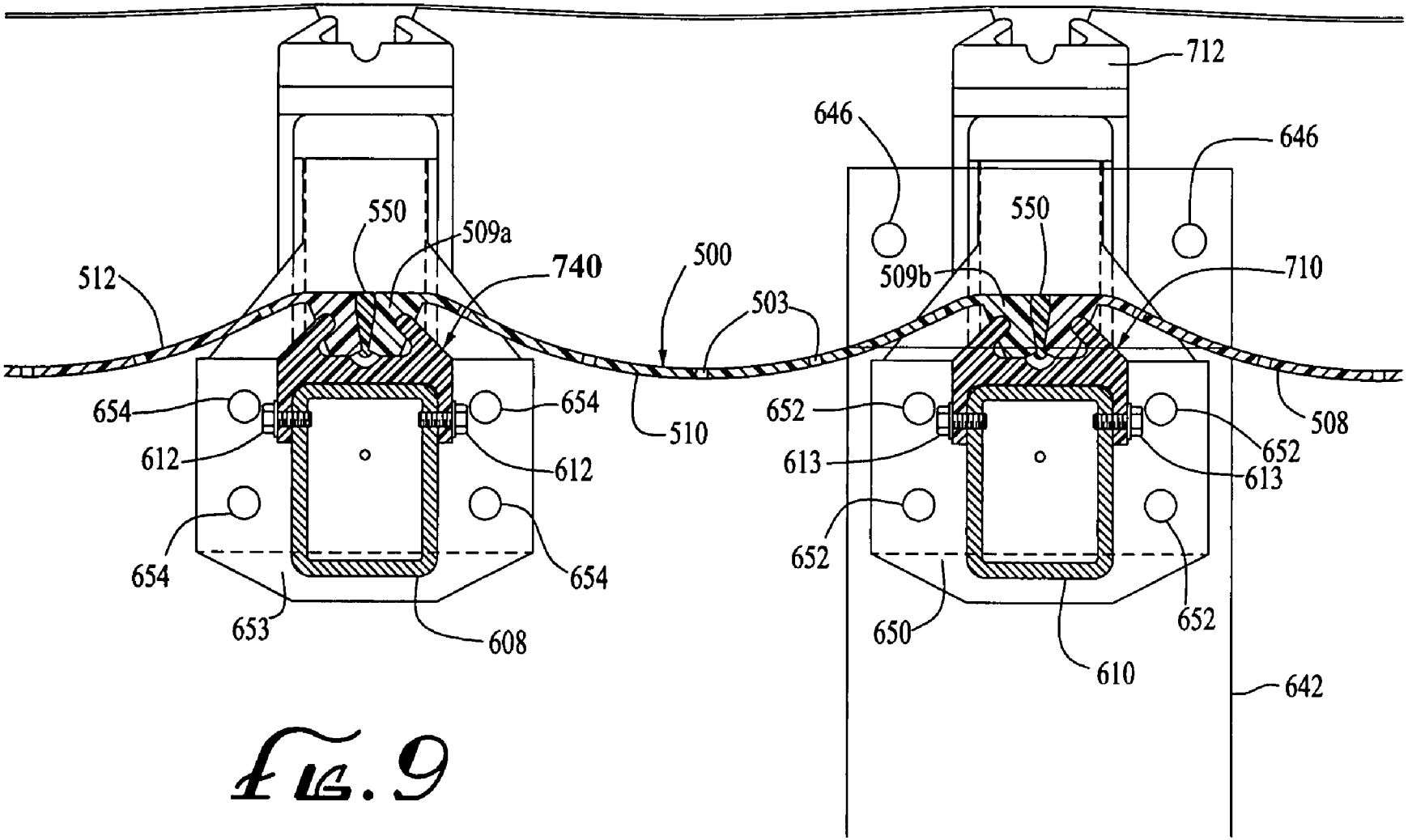
FIG. 9 is a partial cross-section of a portion of a screening apparatus showing another alternate connection mechanism between the sieve mat sections.

FIGS. 9-14 illustrate an alternate sieve mat 500 having a boltless attachment design. The sieve mat 500 comprises mat sections of which sections 508, 510 and 512 are shown in FIG. 9. Each mat section 508, 510, 512 etc. is secured at each tube assembly via the connection mechanism. Each of the sieve mat sections 508, 510, 512 etc. is preferably homogenous, uniform, unitary, and one-piece without splices. Alternately, the mat section may be assembled from multiple pieces such as separately forming the end sections 509*a*, 509*b* and attaching them to the central section 509*c* (see FIG. 13). A single mat section 508, 510, 512 may be removed for replacement or repair without requiring replacement of remaining sieve mat sections. The sieve mat 500 includes perforations along its length (see for example the perforations 503 in mat section 510 of FIG. 9), the perforations being of a size and shape so as to permit particles of a given size to pass through for sorting. The individual perforations may be tapered and arranged in any suitable pattern and location.

As in the previous embodiment, each mat section is supported by a pair of transverse mat supports, in the illustrated portion for example, the mat section 510 is supported by supports 608, 610. The sieve mat supports are in the form of rectangular tubes arranged with the longer sides oriented vertically. Other shapes and orientations for the mat supports or frame tubes may be utilized.

As in the previous embodiment, the sieve mat supports 608, 610 etc. are alternately connected to either the main support frame section 40 (via connector 642) or to the movable balancer support frame section 655. The balancer 655 is supported via shear blocks 660 and vertically supported by the vertical stabilizers 620, 630 which were described above in further detail with reference to elements 420 and 430 of FIGS. 3-6. Each sieve mat section is connected on one end to a frame tube support and on the other end to a balancer tube support. For example, mat section 510 is connected on one end to balancer tube 608 and on the other end to frame tube support 610. The operative functions of these connections will be described in further detail below.

Figure 10:
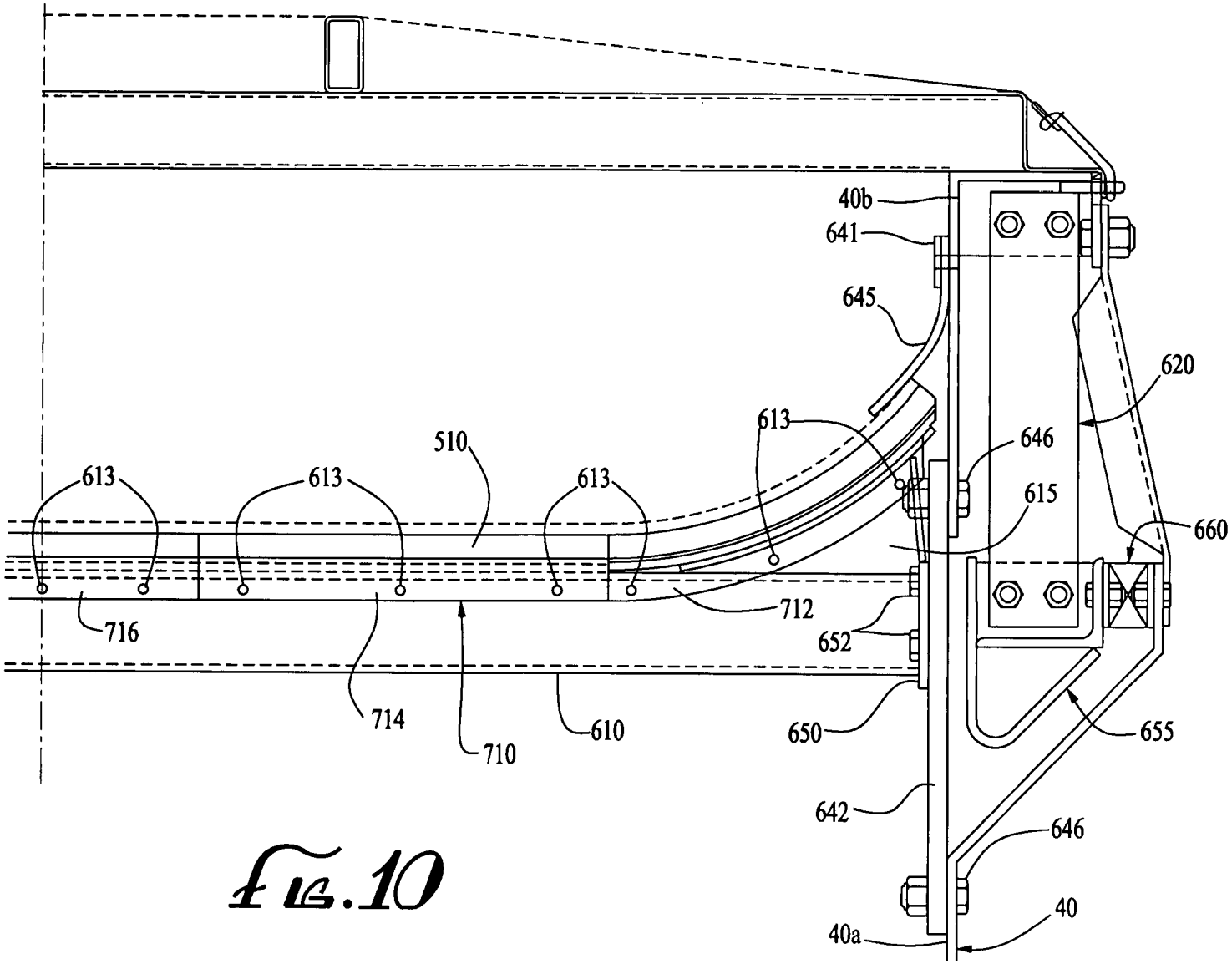
FIG. 10 is a partial cross-sectional view of the apparatus of FIG. 9 showing details of the support connection for the frame tube.

Referring to FIGS. 9 and 10, the frame tube assembly 610 is supported directly to the main support frame section 40 (as in FIGS. 1-2) via connector 642. The frame tube 610 comprises a rectangular tubing arranged below the sieve mat section 510 extending transversely along the width of the frame assembly. The frame tube 610 includes an end flange 650 welded thereon for attachment to the connector 642. The connector 642 has four holes which have been drilled and tapped for accepting the bolts 652 which secure the flange 650 onto the connector 642. The connector 642 is in turn connected by a series of bolts 646. As shown in FIG. 10, the frame tube 610 is directly connected to the frame 40 at both lower section 40*a* and the upper section 40*b* by a connection through the connector plate 642. Other connection mechanisms may be used such as through bolt and nut, welding, rivet, or any suitable fastener.

Figure 11:
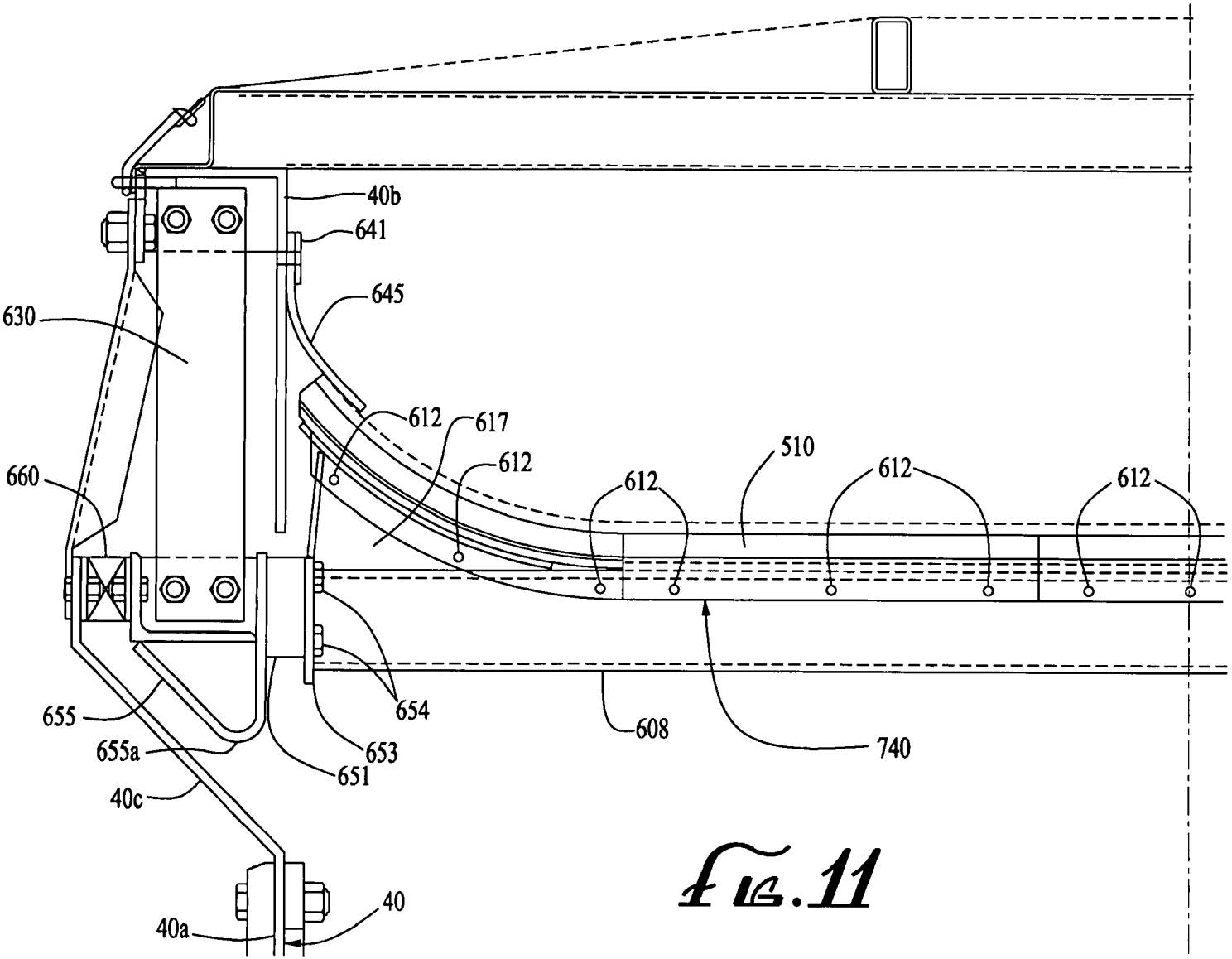
FIG. 11 is a partial cross-sectional view of the apparatus of FIG. 9 showing details of the support connection for the balancer tube.

As best shown in FIGS. 9 and 11, the balancer tube 608 and flange 653 are the same configuration as the frame tube 610 and flange 650. The balancer tube 608 is mounted differently, however, as the flange 653 at the end of the tube 608 is connected to a spacer 651 via bolts 654. The spacer 651 in turn is mounted to the balancer 655. The balancer 655 is generally the same as the balancer 50 of the previous embodiment but has a curved lower section 655*a*.

The mat sections 508, 510, 512 etc. are transversely connected to the respective frame tube on one end and the balancer tube on the other end along the length of the mat section. For example, mat section 510 is connected on one end to the frame tube 610 and on the other end to balancer tube 608. The frame tube 610 includes a clamp bar assembly 710 that is attached to the tube 610 via bolts 613, 613 on opposite sides of the tube 610. Similarly, the balancer tube 608 includes a clamp bar assembly 740 that is attached to the tube 608 via bolts 612, 612 on opposite sides of the tube 608. The clamp bar assemblies 710 and 740 and the mechanisms for clamping the edges of the mat sections thereto are the same. Thus only the clamp bar assembly 710 will be described and should be understood to apply to the clamp bar assembly 740.

The clamp bar assembly 710 may be formed in a single piece, but the assembly is preferably formed in a plurality of sections 712, 714, 716, 718 and 720. End clamp bar sections 712 and 720 are curved sections, while sections 714, 716 and 718 are straight sections. The curved clamp bar sections 712 and 720 are connected to respective gussets 615, 616 attached to the frame tube 610 providing a curved spacer for supporting the curved clamp bar end sections. Similarly, the clamp bar assembly 710 has straight and curved sections, the curved sections being connected to respective gussets 617, 618 attached to the balancer tube 608.

Figure 12A:
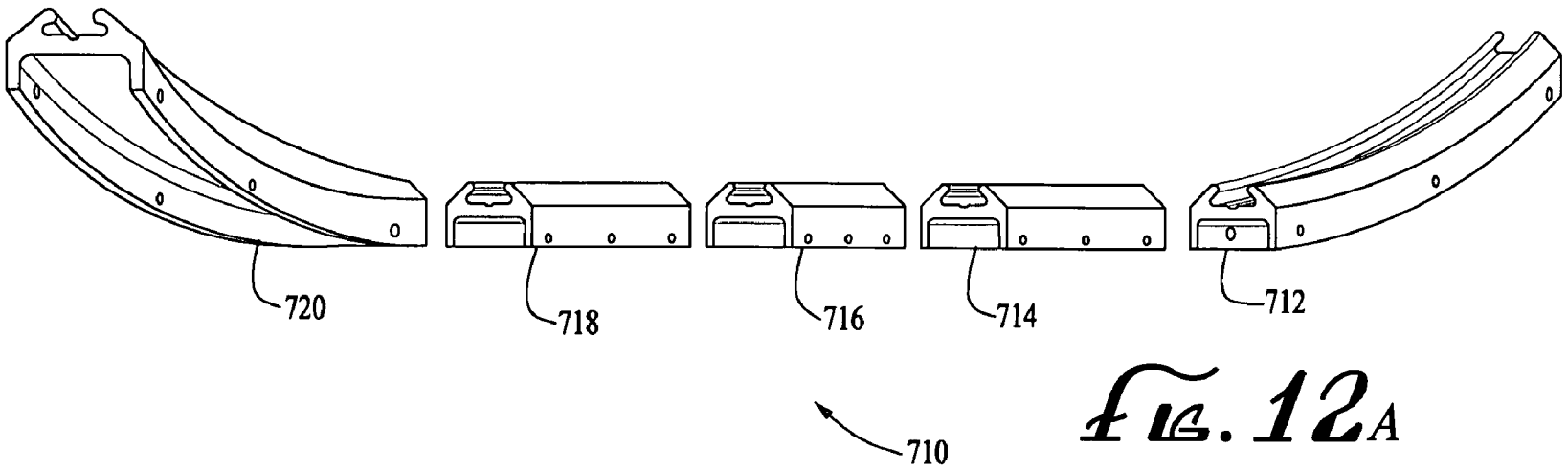
FIG. 12A is an exploded perspective view of sections of the clamp bar assembly of FIGS. 1-9.
Figure 12C:
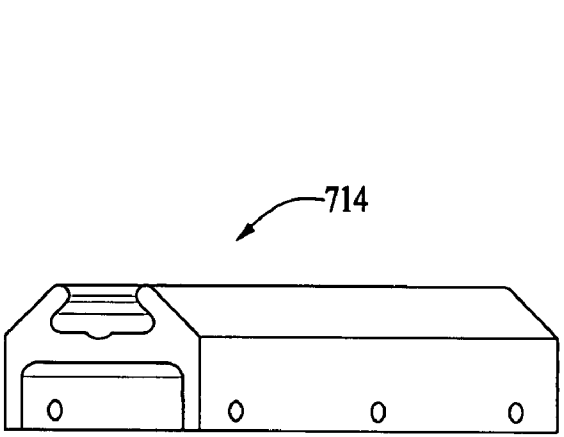
FIG. 12C is a detailed perspective view of a straight section of the clamp bar assembly.
Figure 12B:
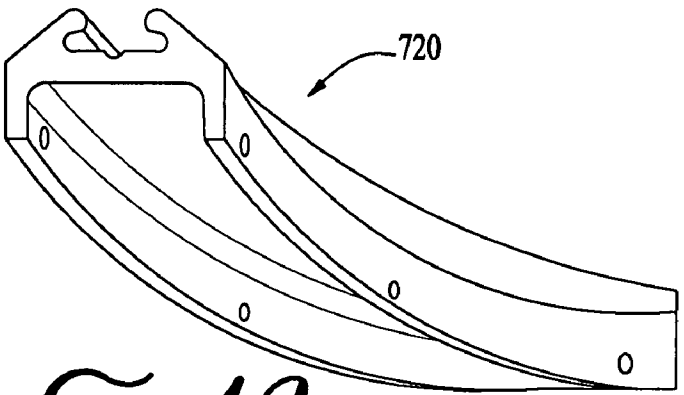
FIG. 12B is a detailed perspective view of a curved section of the clamp bar assembly.

As illustrated in FIGS. 12A, 12B and 12C, the clamp bar assembly 740 is preferably formed in sections. The curved end sections 712, 720 are identical and have a length of about 13 inches (33 mm). The straight sections 714, 718 are identical and have a length of about 16.5 inches (42 mm). The center section 716 has a length of about 12 inches (30.5 mm). Thus three different components are manufactured:

type 1: curved section 13 inches (33 mm);
type 2: straight section 16.5 inches (42 mm);
type 3: straight section 12 inches (30.5 mm).

The modular design of these three components enables various widths for a vibrating screen apparatus to be assembled from these three modular components resulting in manufacturing efficiency. For example, following is a listing of what section types may be used to assemble machines of four different width sizes:

5 ft machine: two type 1 and two type 2;
6 ft machine: two type 1; two type 2; one type 3;
7 ft machine: two type 1; two type 2; two type 3;
8 ft machine: two type 1; two type 2; three type 3.

Thus FIG. 12A illustrates a 6 ft machine width having two type 1 curved sections 712, 720; two type 2 straight sections 714, 718; and one type 3 straight section 716. When installed on the frame bar, the clamp bar sections will be preferably be adjacent each other and preferably touching as shown in FIG. 10.

Figure 13:
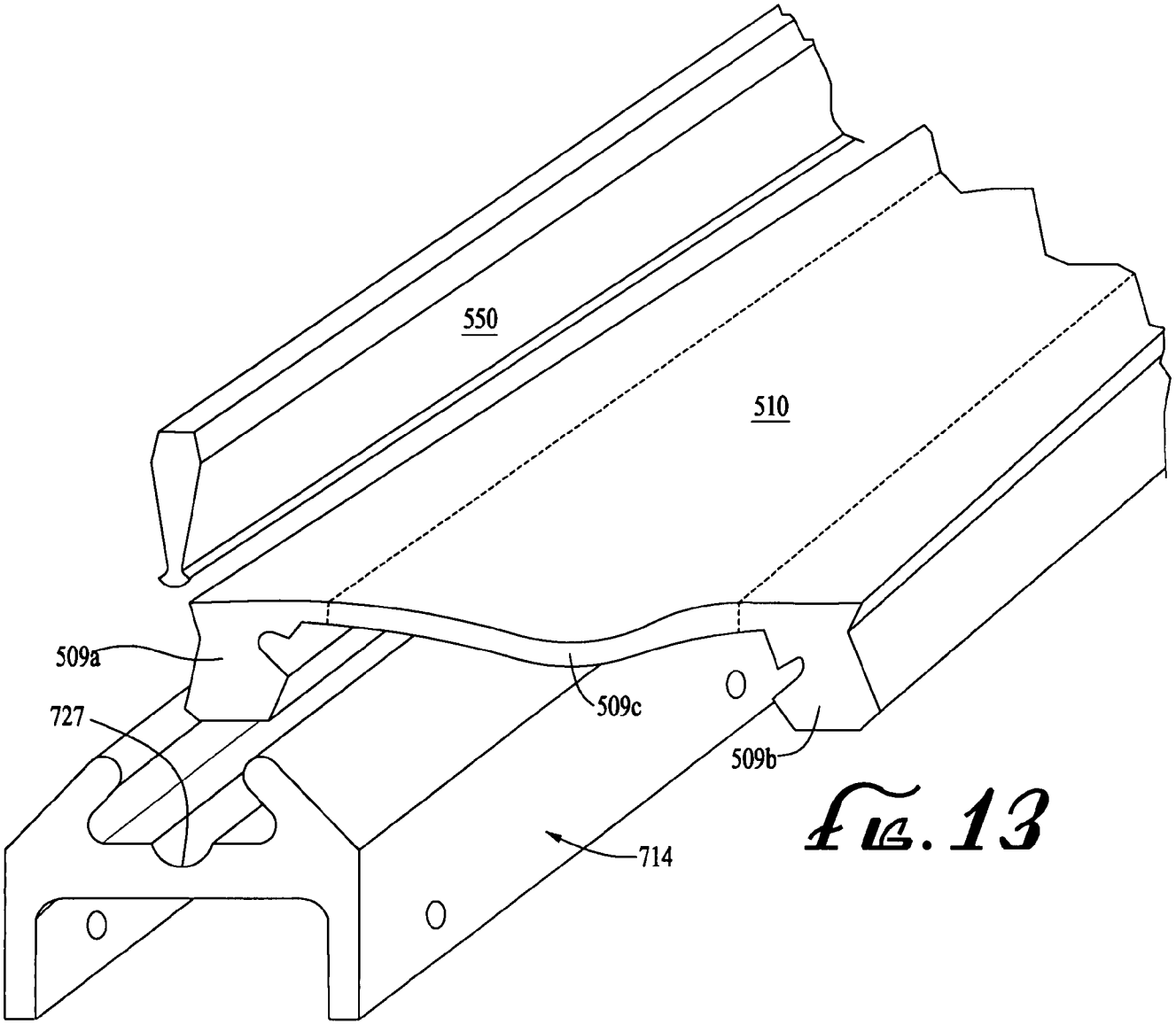
FIG. 13 is an exploded view from a top perspective of the alternate connection mechanism of FIGS. 9-12.
Figure 14:
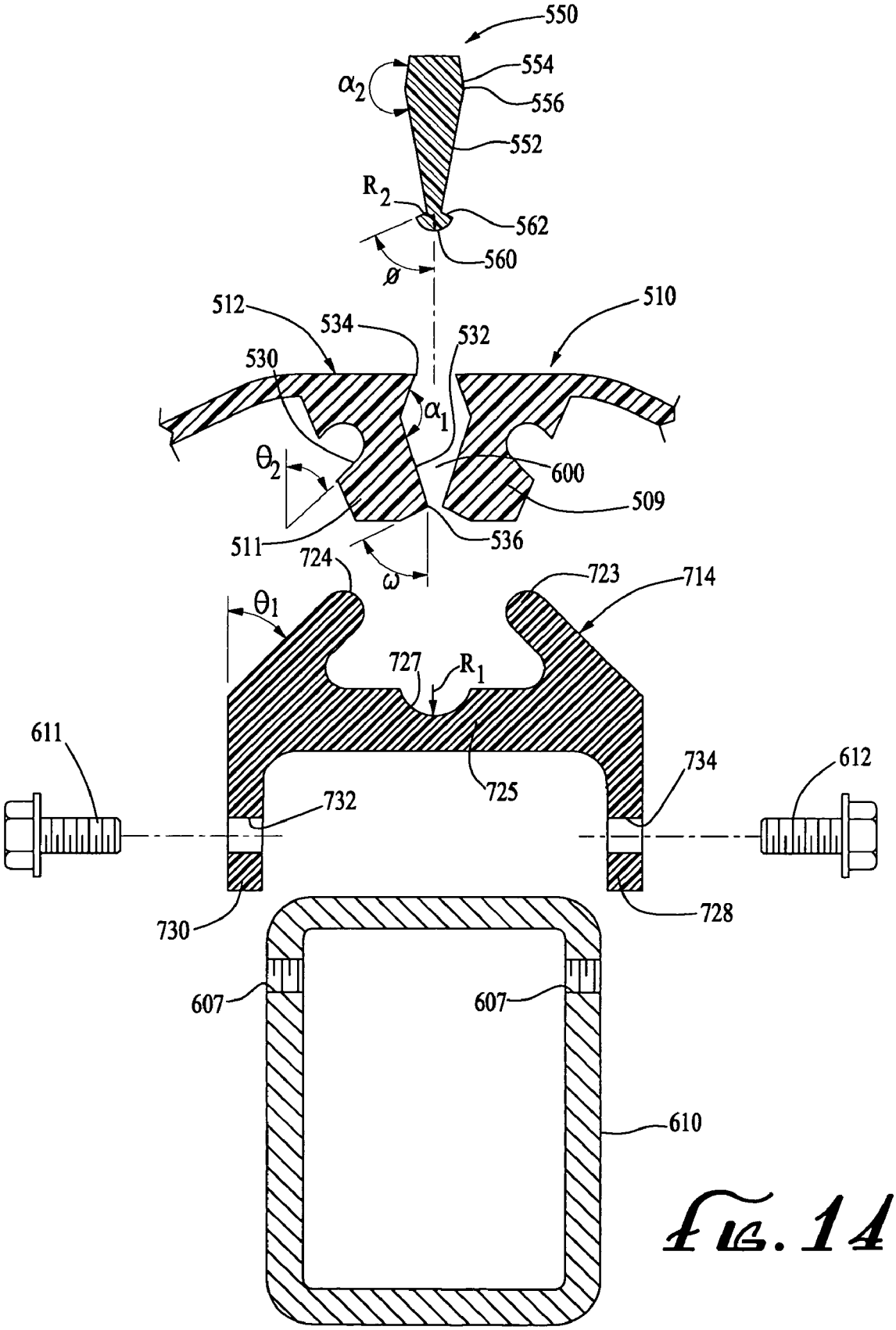
FIG. 14 is a detailed exploded view of components of the connection mechanism of FIGS. 9-13.

FIGS. 13 and 14 illustrate details of a connection system according to a preferred boltless configuration. The clamp bar 714 has a generally H-shape in cross-section with a central bar 725, lower legs 728, 730 and upper arms 723, 724. The upper arms 723, 724 extend upwardly and inwardly, and are inwardly angled at an angle $\theta_1$ of about 30°-60°, or preferably about 45°. The ends are rounded but may be of other shapes. The central bar 725 includes a channel 727 running centrally along its length. The channel 727 is shown having a radius $R_1$.

Each of the clamp assembly sections, such as clamp bar section 714 is placed onto the tube 610. The tube 610 has a series of tapped holes 607 on each side. The clamp section 714 has a U-shaped lower portion comprised of legs 728, 730 that are shaped to sit astride the tube 610. The legs 728, 730 also include holes 734, 732 that are aligned with the holes 607 of the tube 610. The two elements may then be secured together by bolts 612 through the holes. Each clamp section 712, 714 etc. is attached in similar fashion. The clamp bar 714 may be secured by the bolts as illustrated or via clips, adhesive or any other suitable connection mechanism.

In operation, the respective downwardly extending end portions 509, 511 of adjacent sieve mat sections 510, 512 are secured by the clamp bar 714. For example as show in FIG. 14, sieve mat end portion 509 of sieve mat sections 510 is secured in clamp bar 714 next to sieve mat end portion 511 of sieve mat section 512. The sieve mat end portions 509, 511 are configured to mate with and nest within the clamp bar 714. The end portion 511 at its inner surface includes an indentation 530 arranged at an angle $\theta_2$ of about 45° which mates with the upper arm 724 of the clamp bar 714. The outer surface also has an indentation 532 forming an angle $\alpha_1$ of about 160°. The outer surface has an upper lip 534 and a lower lip 536. Once positioned in place within the arms 723, 724 of the clamp bar 714, the sieve mat end portions 509, 511 are secured in place by inserting the retaining wedge 550. The wedge 550 has side surfaces 552, 554 formed at an outward angle $\alpha_2$ for nesting into the indentation 532 of angle $\alpha_1$ of the outer surface of sieve mat end 511. The lower section of the wedge is tapered (i.e. narrowed) until the wedge bottom is reached. The wedge also includes a nipple or retaining ridge 560 at the bottom forming a shoulder or lip 562.

When the sieve mat end portions 511, 509 are inserted into the clamp bar 714 between the arms 723, 724, an opening 600 is formed therebetween. The wedge is then inserted into the opening 600 forcing the end portions 509, 511 outwardly and into the arms 723, 724. The wedge 550 is sized slightly larger than the opening 600 between the sieve mat end portions 511, 509 by about 1.5 to 2.0 mm thereby creating an interference fit.

In practice, the wedge 550 is hammered into position; it may be treated/sprayed with a suitable lubricant such as water or silicone spray to facilitate installation. Once inserted, the wedge 550 is secured in place by tapered surface 554 below lip 534 and by the shoulder 562 of the nipple 560 below lip 536. This shoulder/nipple configuration provides a positive locking mechanism to prevent dislodging of the wedge during operation. The shoulder 562 also provides support for the mat sections. The wedge 550 itself is inhibited from being over-inserted by the wedge taper 552 contacting the angled outer surface 532 of the end section 511 and by the nipple 560 contacting the bottom of channel 727. As shown in FIG. 9, once in place and fully inserted, the wedge 550 has a top surface that is flush with the top surfaces of the sieve mat section 508, 510 and the bottom nipple 560 engaging and nesting in the channel 727. Such a flush top surface without any protruding bolts or fasteners eliminates protrusions that may tend to restrict flow.

Though the wedge 550 may be formed of one or more pieces, it is preferably constructed as a single piece extending the entire width of the sieve mat section 510. In one configuration, the wedge 550 is slightly longer (e.g. 2.5 cm longer) in width than the sieve mat providing an extension beyond the mat edge creating a gripping surface that can be grabbed and pulled when manually removing sieve mat sections.

As shown in FIG. 9, when the wedge 550 is in place, its top surface is flush with the top surface of the sieve mat sections thereby producing a smooth transition surface that does not inhibit product flow. The flush surface also assists the wedge in avoiding wear from the product flow. The channel 727 in the clamp bar provides a gap between the nipple 560 and the clamp bar that permits the wedge nipple 560 to have enough room to be urged downwardly past the bottom edge 536 of the sieve mat end section thereby assisting in wedge insertion.

The attachment system is comprised of three primary sections, the sectional clamp bar assembly 714, the wedge 550 and the sieve mat 500. The preferred material for the sieve mat is polyurethane elastomer with an 85 Shore A hardness. A preferred material for the clamp bar 714 and the wedge 550 is also polyurethane, preferably with a 90 Shore A hardness or harder. The clamp bar 714 may be made of harder polyurethane material, or other suitable material such as some other plastic. Preferably, the material should be sufficiently stiff and durable, but have some impact resilience. The combination provides a polyurethane to polyurethane fit as opposed to polyurethane to metal fit as in other connection systems. The wedge 550 may also be made from other materials such as other plastics or rubber.

In a preferred material, the formula of polyurethane for each part within the system is preferably designed to provide the best properties and performance for the required application, taking into consideration the function during equipment operation. The manufacturing process for each component may be the same or quite similar. One part has flexibility, tensile strength and wear resistance built into its design, while the next part may concentrate on a need for shear strength and impact resistance. The polyurethane is preferably formulated to not only take into consideration the performance needs of the operating equipment, but also other environmental criteria that they the part may be operating in relating to chemical resistance, temperature conditions and potentially other factors.

The parts may be made by any suitable method such as casting or injection molding. Casting of the parts is the preferred method of polyurethane manufacturing because of the heavy cross sectional areas that would be prone to sink holes and deformation during the curing process if the parts were injection molded. The size of the parts and parting line requirements, multiple axis removal of mold parts through the use of slides, sectional dies, and even a possible need for an elaborate core section in some of the parts would make it very difficult to produce injection molding. Injection molds may also require elaborate multiple gating, reservoirs and cooling systems to effectively produce the part. An injection molding process may still be subject to potential fit-up issues between components that could result in quality control issues. Alternately, the parts may be made by different processes, such as the sieve mat 500 made by casting, the clamp assembly 700 made by injection molding, and the wedge 550 made by an extrusion process. Casting is preferred as being a single process that is generally usable on all three parts. For certain parts, it may be preferred to complete the design by secondary machining, cutting or other processing after the initial cast or mold has cured.

The clamp bar sections 710 are the hardest and most rigid part and may be made by casting, extrusion or injection molding. The retaining wedge 550 is somewhat softer and more flexible than the clamp bar parts, but not as resilient and flexible as the screen mats. The retaining wedge 550 may be produced by an extrusion method as an alternative to casting which may allow longer pieces to be made in a single piece. The screen mats are also preferably produced by casting the polyurethane in a desired configuration. The specific formulation for the polyurethane if the sieve mat will depend on the application such as whether the mat is used as a flip-flow device or as a conveyor. Flexible strength, elasticity, impact resistance, wear factors, chemical resistance and other physical environment issues are considerations for the polyurethane formulation. The central portion of the mat 510 and the end sections 509, 512 are preferably molded/cast as one piece to ensure uniform properties throughout the mat. When inserted into the clamp bar 714, the mat end sections 509, 512 are forced into a tight interference fit by inserting the retaining wedge 550. The mat material should be resilient enough to compress into the arms 723, 724 of the clamp bar 714 and follow the curvature of the clamp bar, yet still be strong enough to not pull apart in tensile. The mats may be cast with a variety of openings or apertures in them for the screening operation being performed. Though casting is a preferred method for producing the mats, they may also be made as blanks without any holes or perforations. Whatever hole configuration is desired for any given screening applications can be put into the mats in a secondary operation. The preferred methods for secondary processing of the mats for hole pattern installation are either water jet cutting or punching or other suitable method.

The above-described connection design may provide one or more of the following advantages:

- Fast, simple, easy, and secure screen mat installation.
- Materials flow freely without fastener contact; there are no protruding fasteners to restrict flow.
- Minimizes "dead" area at cross members for maximum screen open area and efficiency.
- Eliminates problematic less precise urethane-to-metal screen mat connections with associated sharp/abrupt edges.
- Underlying screen mat connection support, with higher section modulus, provides superior strength properties and protection from repeated material impacts.

The urethane or other plastic clamp bar assembly absorbs shock thereby reducing potential cross tube fractures, cracks and failures.

The clamp design distributes load more evenly—no pinch points between the sieve mat and the arms 723, 724 having rounded ends.

Positive locking configuration of the wedge 550 ensures that the wedge remains in position flush with the top surface of the sieve mat. Wedge strips of other designs may not remain flush with the top of the screen mat and can require re-hammering or re-pounding to reposition—such wedge strips can also be damaged when loose and extending into the product flow.

The clamp bar supports 714 utilize a deep, reinforced cross-sectional area.

The polyurethane or other plastic clamp bar provides a high section modulus that is resistant to vertical impact.

The clamp bar 714 made of polyurethane or other plastic may be manufactured by extrusion or other molding methods which may be more easily manufactured to a tight tolerance resulting in a more precise fit between components.

Other systems employ a U-shaped tube for the frame tube and/or connector that requires a large press with custom made dies for forming. The combination of the molded clamp bar 714 enables the frame tube 610 to comprise common/conventional structural tubing.

The various embodiments disclosed may be combined together or separately utilized. For example, the vertical stabilizers and/or the horizontal compression axis shear blocks may be used with flexible mat conveyors or screening machines of alternate configurations, including prior art machines.

While the inventions have been particularly shown and described with reference to certain embodiments, it will be understood by those skilled in the art that various changes in form and detail may be made without departing from the spirit and scope of the invention. The scope of the present invention should, therefore, be determined only by the following claims.

The invention claimed is:

1. A screening or conveying apparatus comprising a base;

a frame assembly comprised of a main support frame section mounted on the base;

a plurality of mat supports spaced from each other and arranged transversely to a length of the frame assembly;

a plurality of flexible mat sections, each mat section being comprised of plastic and having downwardly extending end sections, each mat section being supported between an adjacent pair of first and second mat supports, wherein an adjacent pair of first and second mat sections are supported by a common mat support, wherein the common mat support comprises a cross member extending substantially across a transverse width of the first and second mat sections, the first and second mat sections being connected to the cross member via a connection assembly, the connection assembly comprising a clamp bar assembly comprised of plastic and removably mounted to the cross member, the clamp bar assembly having (a) an upper section with first and second inwardly and upwardly extending arms for securing adjacent end sections of the first and second mat sections therebetween and (b) a lower section sitting astride the cross member, wherein an adjacent pair of first and second mat supports are movable relative to each other for causing the flexible mat section supported therebetween to be alternately tensioned and relaxed in a flip-flow action via movement of a first mat support relative to the second mat support adjacent thereto.

2. An apparatus according to claim 1 wherein the first extending arm of the clamp bar assembly is configured to mate with and nest within an indentation disposed on an inside surface of the end section of the first mat section and wherein the second extending arm of the clamp bar assembly is configured to mate with and nest within an indentation disposed on an inside surface of the end section of the second mat section.

3. An apparatus according to claim 2 further comprising a wedge extending a transverse width of the mat sections and insertable between the end sections of the first and second mat sections for urging the end sections outwardly into the arms of the clamp bar assembly.

4. An apparatus according to claim 3 wherein the wedge includes a bottom shoulder section extending below and engaging an underside of the end sections for retaining the wedge in place between the mat sections.

5. An apparatus according to claim 3 wherein the wedge includes a first outwardly extending ridge on one side configured to mate with and nest within an indentation within an outer surface of the end section of the first mat section and wherein the second extending arm of the clamp bar is configured to mate with and nest within an indentation within an outer surface of the end section of the second mat section.

6. An apparatus according to claim 1 wherein the cross member comprises a tubular-shaped frame tube, the clamp bar assembly is connected to the tubular-shaped frame tube via bolts.

7. An apparatus according to claim 1 wherein the mat support comprises a frame tube having a rectangular cross-section.

8. A screening or conveying apparatus comprising a base;

a frame assembly comprised of a main support frame section mounted on the base;

a plurality of mat supports spaced from each other and arranged transversely to a length of the frame assembly;

a plurality of flexible mat sections, each mat section having downwardly extending end sections, each mat section being supported between an adjacent pair of mat supports, wherein an adjacent pair of first and second mat sections are supported by a common mat support, the first and second mat sections being connected to the common mat support via a connection assembly, the connection assembly comprising a clamp bar assembly removably mounted to the common mat support, the clamp bar assembly having first and second inwardly and upwardly extending arms for securing adjacent end sections of the first and second mat sections therebetween, wherein the clamp bar assembly comprises a plurality of separate clamp bar sections assembled laterally along the length of the common mat support.

9. An apparatus according to claim 8 wherein the clamp bar sections comprise first and second upwardly curved end sections and one or more straight central sections aligned between the upwardly curved end sections.

10. An apparatus according to claim 9 wherein the first and second upwardly curved end sections have the same configuration as each other.

11. An apparatus according to claim 9 wherein the mat support comprises a frame tube and wherein the first upwardly curved end section is attached to the frame tube via a gusset.

12. An apparatus according to claim 1 wherein the frame assembly comprises a main support frame section mounted on the base, and a movable support frame section movably mounted on the main support frame section, wherein every other of the mat support is connected to the main support frame section and the other mat supports are connected to the movable support frame section.

13. An apparatus according to claim 1 wherein the first and second inwardly and upwardly extending arms are disposed at an angle of about 30° to 60° from vertical.

14. An apparatus according to claim 1 wherein the first and second inwardly and upwardly extending arms are disposed at an angle of about 45° from vertical.

15. A screening or conveying apparatus comprising a base;

a frame assembly comprised of a main support frame section mounted on the base, and a movable support frame section movably mounted on the main support frame section;

a plurality of mat supports spaced transversely along the length of the frame assembly, wherein every other mat support is connected to the main support frame section and the other mat supports are connected to the movable support frame section;

a plurality of flexible mat sections, each mat section having downwardly extending edge sections, each mat section being supported between an adjacent pair of mat supports, wherein an adjacent pair of first and second mat sections are supported by a common mat support;

a connection assembly mounted to the common mat support for connecting the first and second mat sections to the common mat support, the connection assembly comprising a clamp bar attached to the common support, the clamp bar having inwardly and upwardly extending arms and being constructed and arranged for accepting adjacent end sections of the first and second mat sections between the arms, a wedge insertable between and against the first and second mat sections for securing the adjacent end sections of the first and second mat sections within the clamp bar and against the arms, wherein the clamp bar and the flexible mat sections are each made from plastic.

16. An apparatus according to claim 15 wherein the clamp bar is made from a first polyurethane plastic material and the flexible mat sections are made from a second polyurethane plastic material, wherein the first polyurethane plastic material is harder than the second polyurethane plastic material.

17. An apparatus according to claim 3 wherein the wedge includes an enlarged bottom section extending below and contacting an underside of the end sections when inserted therebetween for retaining the wedge in place between the mat sections.

18. An apparatus according to claim 3 wherein the wedge includes a top surface such that when the wedge is inserted into position between the end sections, the top surface of the wedge is flush with top surfaces of the sieve mat sections.

19. An apparatus according to claim 1 wherein each mat section is formed in a casting or molding process, with each end section being formed with an indentation on an inside surface thereof, wherein the first extending arm of the clamp bar assembly is configured to mate with and nest within the indentation formed on the inside surface of the end section of the first mat section and wherein the second extending arm of the clamp bar assembly is configured to mate with and nest within the indentation formed on the inside surface of the end section of the second mat section.

20. An apparatus according to claim 19 wherein each mat end section is formed with an indentation on an outside surface thereof.

21. An apparatus according to claim 3 wherein clamp bar assembly comprises a central bar, the upwardly extending arms disposed on opposite sides of the central bar, wherein the central bar is constructed with a channel disposed in a top surface inwardly upwardly extending thereof and between the and extending arms, the channel the length of the clamp bar assembly, wherein when fully inserted, the wedge engages the central bar, nesting within the channel.

22. An apparatus according to claim 8 wherein each clamp bar section is constructed of cast or molded plastic.

23. An apparatus according to claim 8 further comprising a wedge extending a transverse width of the mat sections and insertable between the end sections of the first and second mat sections for urging the end sections outwardly into the arms of the clamp bar assembly, wherein clamp bar section comprises a central bar, the upwardly extending arms disposed on opposite sides of the central bar, wherein the central bar is constructed with a channel disposed in a top surface and between the upwardly extending arms, the channel extending the length of the clamp bar section, wherein when fully inserted, the wedge engages the central bar, nesting within the channel.

24. An apparatus according to claim 1 wherein the clamp bar assembly has a generally H-shaped cross section.

25. An apparatus according to claim 1 wherein the clamp bar assembly comprises a plurality of separate clamp bar sections assembled laterally along the common mat support, the plurality of separate clamp bar sections including first and second upwardly curved end sections and one or more straight central sections aligned between the upwardly curved end sections.

26. An apparatus according to claim 8 wherein the clamp bar section has a generally H-shaped cross section.

* * * * *

UNITED STATES PATENT AND TRADEMARK OFFICE

CERTIFICATE OF CORRECTION

PATENT NO. : 7,654,394 B2
APPLICATION NO. : 11/036599
DATED : February 2, 2010
INVENTOR(S) : Andrew T. LaVeine et al.

It is certified that error appears in the above-identified patent and that said Letters Patent is hereby corrected as shown below:

Column 13
Line 65, change "they the" to --the--.

Column 14
Line 32, change "if" to --of--.

Column 17
Line 9, change "support" to --supports--.

Column 18
Lines 25-26, change "surface inwardly upwardly extending thereof and between the and extending arms, the channel" to --surface thereof and between the inwardly and upwardly extending arms, the channel extending--.

Signed and Sealed this

Sixteenth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,394 B2
APPLICATION NO. : 11/036599
DATED : February 2, 2010
INVENTOR(S) : LaVeine et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 768 days.

Signed and Sealed this

Twenty-third Day of November, 2010

David J. Kappos

David J. Kappos
*Director of the United States Patent and Trademark Office*